US010443961B2

(12) United States Patent
Widmann

(10) Patent No.: US 10,443,961 B2
(45) Date of Patent: Oct. 15, 2019

(54) HEAT EXCHANGER ELEMENTS, IN PARTICULAR FOR FLUE GAS CLEANING SYSTEMS OF POWER STATIONS

(71) Applicants: ElringKlinger AG, Dettingen (DE); ElringKlinger Kunststofftechnik GmbH, Bietigheim-Bissingen (DE)

(72) Inventor: Katja Widmann, Aalen (DE)

(73) Assignees: ElringKlinger AG, Dettingen (DE); ElringKlinger Kunststofftechnik GmbH, Bietigheim-Bissingen (DE)

( * ) Notice: Subject to any disclaimer, the term of this patent is extended or adjusted under 35 U.S.C. 154(b) by 0 days.

(21) Appl. No.: 15/808,393

(22) Filed: Nov. 9, 2017

(65) Prior Publication Data

US 2018/0066903 A1 Mar. 8, 2018

Related U.S. Application Data

(63) Continuation of application No. PCT/EP2016/060537, filed on May 11, 2016.

(30) Foreign Application Priority Data

May 12, 2015 (DE) ..... 10 2015 107 476

(51) Int. Cl.

| | |
|---|---|
| ***F28F 21/06*** | (2006.01) |
| ***F28D 19/04*** | (2006.01) |
| *F28D 17/00* | (2006.01) |

(52) U.S. Cl.

CPC ..... *F28F 21/06* (2013.01); *F28D 19/044* (2013.01); *F28F 2255/06* (2013.01)

(58) Field of Classification Search

CPC ..... F28D 7/087; F28D 19/044; F28F 21/06; F28F 2255/06; F28F 1/02

USPC ..... 165/10

See application file for complete search history.

(56) References Cited

U.S. PATENT DOCUMENTS

| | | | | |
|---|---|---|---|---|
| 3,789,916 A | | 2/1974 | Lindahl | |
| 4,832,999 A | * | 5/1989 | Sweet | E04C 2/365 165/10 |
| 5,152,184 A | * | 10/1992 | Schroeder | B01L 3/508 220/23.87 |

(Continued)

FOREIGN PATENT DOCUMENTS

| | | |
|---|---|---|
| DE | 195 12 351 | 11/1996 |
| DE | 10 2012 109 184 | 3/2014 |
| EP | 1 046 012 | 10/2000 |

(Continued)

*Primary Examiner* — Davis D Hwu

(74) *Attorney, Agent, or Firm* — Womble Bond Dickinson (US) LLP

(57) ABSTRACT

In the case of a heat exchanger element for equipping heat exchangers of flue gas cleaning systems of power stations, the heat exchanger element can be formed by a block shaped honeycomb body having four outer faces and two substantially parallel end faces and a sealing edge. The honeycomb body can be manufactured from a plastics material including a plurality of mutually parallel flow channels which are separated from each other by channel walls. The flow channels extend from the one to the other end face, and the sealing edge can be arranged in the region of one of the end faces and substantially parallel to this end face and extends away from the honeycomb body at the periphery of the honeycomb body.

23 Claims, 16 Drawing Sheets

(56) References Cited

U.S. PATENT DOCUMENTS

| | | | | |
|---|---|---|---|---|
| 2001/0026110 | A1 | 10/2001 | Kurosawa et al. | |
| 2010/0270011 | A1* | 10/2010 | Takahashi | F28D 7/0025 165/148 |

FOREIGN PATENT DOCUMENTS

| | | |
|---|---|---|
| EP | 1 138 368 | 10/2001 |
| EP | 1 547 666 | 6/2005 |
| GB | 1 452 290 | 10/1976 |
| GB | 2 170 586 | 8/1986 |
| WO | WO 2013/127594 | 9/2013 |

* cited by examiner

HEAT EXCHANGER ELEMENTS, IN PARTICULAR FOR FLUE GAS CLEANING SYSTEMS OF POWER STATIONS

CROSS-REFERENCE TO RELATED APPLICATIONS

This application is a continuation of international application number PCT/EP2016/060537 filed on May 11, 2016 and claims the benefit of German application number 10 2015 107 476.1 filed on May 12, 2015, which are incorporated herein by reference in their entirety and for all purposes.

BACKGROUND OF THE INVENTION

The invention relates to heat exchanger elements, in particular, for equipping heat exchangers for flue gas cleaning systems of power stations that are frequently equipped with a rotor which comprises a plurality of chambers for accommodating individual heat exchanger elements. The heat exchangers in a rotary implementation are frequently of the so-called Ljungström type. In the case of heat exchangers utilizing a stationary heat accumulator mass (stator), a design according to the so-called Rothemühle principle is frequently employed. Here too, the heat exchanger elements are inserted separately into chambers.

The heat exchanger elements have a honeycomb body consisting of a plastics material which is preferably matched to the geometry of the chambers. The honeycomb body comprises a plurality of mutually parallel flow channels which are separated from each other by channel walls and extend from one end face of the honeycomb body to the opposite end face.

Heat exchanger elements of the type mentioned hereinabove for employment in flue gas cleaning systems of power stations are known from the German patent specification DE 195 12 351 C1 for example. The heat exchanger elements disclosed therein are manufactured from reclaimed polytetrafluoroethylene alone or in a mixture with another plastics material and optionally they contain fillers.

The heat exchanger elements according to the invention are envisaged in particular for employment in so-called Ljungström heat exchangers and heat exchangers according to the Rothemühle principle. When employed in flue gas desulphurizing systems (REA), clean and raw gas flows are fed spatially separated in opposite directions through the heat exchanger/rotor which is equipped with the heat exchanger elements. In the region in which the raw or flue gas flows through the heat exchanger (rotor/stator), the heat exchanger elements are heated and the raw or flue gas is thereby cooled. In the region in which the clean gas flows through the heat exchanger (rotor/stator) in the reverse direction, the heat exchanger elements deliver energy to the clean gas whereby the temperature thereof rises whilst the heat exchanger elements then cool down again.

During the process of cooling the raw or flue gases, they can reach a temperature below the so-called dew point ($T_D$) below which the water vapor contained in the raw or flue gas condenses and, together with fractions of $SO_3$, HF and HCl, settles on the surfaces of the heat exchanger elements in the form of a highly corrosive mixture. The position within a heat exchanger from which the cooled raw or flue gases emerge wherein the temperature may possibly fall below the dew point $T_D$ is referred to as the cold end position. The cold end position can be in the lower region of the rotor (lower cold end position) or in the upper region of the rotor (upper cold end position) in dependence upon whether the flue gas is supplied from the upper end or the lower end of the rotor.

Consequently, apart from the temperature resistance demanded of the heat exchanger elements employed in these regions of the heat exchanger, a very high corrosion resistance is also required. Since the highly corrosive precipitate, typically mixed with ash residues, has to be regularly removed from the heat exchanger elements, easy handling and an efficient way of cleaning the heat exchanger elements are likewise of great economic importance. These requirements are met in satisfactory manner by the heat exchanger elements manufactured from plastics material.

Nevertheless, over long periods of operation, there has proved to be a problem under the given conditions that the heat exchanger/rotors which are typically manufactured from highly corrosion resistant steel remain in contact with the corrosive precipitates for a long period of time in the cold end positions that are equipped with the heat exchanger elements, and, due to the changing temperature conditions, they are inclined to corrode which requires that the heat exchanger parts and in particular the chamber walls be regularly replaced during the long lifetime of the heat exchangers. Hence, due alone to the stoppage of the heat exchangers entailed thereby, there are substantial economic costs and in addition to this, there are also the costs of the actual repair of the heat exchanger.

In the prior art, one has already tried to counter this problem by using an enamel coating on the heat exchanger parts. However, this has not proved to be sufficient in many cases.

Heat exchanger rotors have been proposed in WO 2013/127594 A1 wherein carbon and graphitic materials have been resorted to. This solution is comparatively expensive however.

The object of the invention is it to propose a heat exchanger element in which at least the tendency of the heat exchangers (rotors/stators) and in particular the chamber walls thereof to corrode is reduced and consequently the intervals between the individual repairs can be prolonged and possibly even the overall lifetime of the heat exchangers (rotors/stators) can also be prolonged so that they become substantially more economical to operate.

SUMMARY OF THE INVENTION

In accordance with the invention, this object is achieved by a heat exchanger element incorporating the features disclosed in claim 1.

The heat exchanger elements according to the invention are equipped with a sealing edge which is arranged in the region of an end face of the honeycomb body and is substantially parallel thereto. The sealing edge extends around the honeycomb body along the outer faces thereof.

The spacing between the walls of a heat exchanger (rotor/stator) chamber and the heat exchanger element according to the invention or the honeycomb block thereof can thus be minimized in the region of at least one of the end faces or even entirely eliminated.

Surprisingly, merely due to having just a single sealing edge, it is possible to concentrate the flow pattern of the raw gas through the heat exchanger to the regions of the heat exchanger elements in such a way that the walls of the chambers of the heat exchangers in which the heat exchanger elements are placed are, to a great extent, shielded from the corrosively effective components of the raw gas and the precipitation thereof at this point is greatly reduced, if not even substantially avoided.

The heat exchanger elements of the present invention not only offer outstanding corrosion protection but also have very good heat transporting properties.

Furthermore, it has been surprisingly established that it is not necessary for the sealing edge to abut on the surfaces of the heat exchanger chambers in a sealed manner in order, to a great extent, suppress the tendency to corrosion. The sealing edge can, for example, be dimensioned in such a way that there remains a certain amount of play of approx. 5 mm or less, preferably, approx. 2 mm or less from the sealing edge to the chamber wall. The honeycomb block can be kept at a substantially greater spacing to the heat exchanger wall, for example, approx. 10 mm.

Hereinafter, reference will frequently be made to the rotor as a heat exchanger, but these embodiments also generally apply for heat exchangers using a stationary, not a rotary heat accumulator mass which is also referred to as a stator and which has chambers for accommodating heat exchanger elements even if this is not mentioned in a particular case.

The sealing edge of the heat exchanger elements according to the invention is arranged next to the end face of the heat exchanger element which neighbors the upper face of the rotor/stator (upper cold end position) or the lower face of the rotor/stator (lower cold end position). In accordance with the invention, sealing edges may also be provided at both end faces of the heat exchanger element.

Surprisingly moreover, it has transpired that an arrangement involving just a single sealing edge on the respective downstream side of the heat exchanger element best fulfils this object.

In accordance with a variant of the heat exchanger element according to the invention, the sealing edge is formed in one-piece with the honeycomb body.

In accordance with an alternative variant of the heat exchanger element according to the invention, the sealing edge is in the form of a separate component which is optionally connected to the honeycomb body in positive- or force-locking manner or by a substance-to-substance bond. Moreover, the sealing edge can be held on the honeycomb body by means of securing elements.

The heat exchanger element according to the invention may comprise a sealing edge which has an open honeycomb structure, whereby the sealing edge is then manufactured with the honeycomb body, preferably in one-piece manner. Preferably, the honeycomb structure is covered at least partially with a planar material, in particular a foil in substantially gas-impermeable manner. Alternatively, the open honeycomb structure could be closed by a compression or filling process.

The heat exchanger element according to the invention may also comprise a sealing edge having a compact, substantially gas-impermeable structure.

The sealing edge of the heat exchanger elements according to the invention is preferably made of a plastics material which is selected, in particular, from the plastics material of the honeycomb body and perfluoroalkoxypolymer material (PFA).

If the heat exchanger elements according to the invention are installed in the heat exchanger (rotor) in the so-called upper cold end position, the sealing edge is preferably dimensioned in such a way that it rests upon at least two mutually opposite, radially extending side walls of a heat exchanger chamber. This thereby achieves the result that the end faces of these side walls are also protected.

Preferably, the sealing edge on two mutually opposite sides of the honeycomb body is dimensioned in such a way that the sealing edge directly borders a sealing edge of an adjoining heat exchanger element in the circumferential direction of the rotor and further preferred, that it overlaps it.

In the latter case, the sealing edge of the heat exchanger elements according to the invention is preferably formed in the region of a first outer face of the honeycomb body with a recess running parallel to the outer face on the upper face thereof and is formed in the region of a second outer face located opposite the first outer face with a complementary recess on the lower face thereof which extends parallel to the second outer face of the honeycomb body.

In addition, interlocking elements can be formed in the region of the recesses of the upper and lower faces of the sealing edge which enable the heat exchanger elements to be securely positioned in the rotor in the circumferential direction of the rotor.

In the case of the heat exchanger elements having complementary geometries on two oppositely located outer faces, the heat exchanger elements are mutually stabilized in the given installation position thereof in the heat exchanger so that in, a preferred embodiment of the heat exchanger, one can dispense with a plurality of partition walls in the cold end position which would otherwise form individual seating chambers for the heat elements. This applies in particular in the case of the installation of the heat exchanger elements according to the invention in an upper cold end position.

This not only leads to a considerable reduction in the risk of corrosion but additionally results in a reduction in weight on the part of the heat exchanger as well as a saving in material in the manufacture thereof.

In accordance with the invention, the sealing edge can serve as a carrier for the honeycomb body.

To this end, it suffices for the sealing edge serving as a carrier of the honeycomb body to be provided at two oppositely located outer faces of the honeycomb body with bearing surfaces which serve to provide support at or on a wall such as the wall of a seating chamber, of the rotor/stator of the heat exchanger for example.

It is preferred that the bearing surfaces be positioned on such outer faces of the honeycomb block as extend substantially parallel to the radial direction of the heat exchanger.

The heat exchanger elements according to the invention can also be equipped with a mounting in which the honeycomb body is accommodated. Hereby, the mounting can be dimensioned in such a way that further heat exchanger elements can also be accommodated if so required.

When selecting the plastics material, it is preferred that this comprise a plastics material, which contains virgin polytetrafluoroethylene (PTFE) in a proportion of approx. 80 weight % or more and optionally a high performance polymer differing from the PTFE in a proportion of approx. 20 weight % or less. Here, surprisingly, not only is it possible to manufacture honeycomb bodies under considerably less demanding conditions than the honeycomb body described in DE 195 12 351 C1, but, moreover, the honeycomb bodies of the heat exchanger elements according to the invention also exhibit mechanical strength properties, in particular, tear resistance and tear elongation, which are considerably higher than those for conventionally manufactured honeycomb bodies.

Preferably, a virgin PTFE with an enthalpy of fusion of approx. 40 J/g or more is used as the plastics material.

The density of preferred PTFE materials amounts to approx. 2.1 g/cm$^3$ or more.

The virgin PTFE to be used in accordance with the invention can comprise a co-monomer component of approx. 1 weight % or less, preferably, approx. 0.1 weight % or less. Virgin PTFE materials with such a co-monomer component are typically weldable without the addition of extraneous material (e.g., PFA). Typical co-monomers are hexafluoropropylene, perfluoroalkyl vinyl ether, perfluor (2,2-dimethyl-1,3-dioxole) and chlorotrifluoroethylene.

In accordance with the invention, it is preferred that use be made of virgin PTFE and optionally a high performance polymer differing from the PTFE having an average primary particle size $D_{50}$ of approx. 10 μm to approx. 200 μm, preferably, approx. 10 μm to approx. 100 μm. By virtue of these particle sizes, the following features in particular can be achieved in the production of the honeycomb blocks:

- good surface properties, in particular, low surface roughness and ease of cleaning,
- homogeneous distributions of the optionally co-processed fillers,
- good mechanical properties, in particular high tear resistance and tear elongation, and
- good mechanical properties even when using low to average compressive pressures.

Sintered PTFE, and reclaimed PTFE is also to be counted therein, can only be obtained with particle sizes of approx. 400 μm or more due to the lower crystallinity thereof with respect to virgin PTFE.

Reference was made above to the primary particle size since particle agglomerates of virginal PTFE having considerably greater particle sizes are also processable presupposing that the particulate agglomerates break down into their primary particles under the processing conditions. For example, particulate agglomerates having particle sizes of 100 μm to 3000 μm can be employed if they break down into the primary particles at approx. 150 bar or less.

Suitable fillers contain both non-metallic and metallic fillers which can also be used in a mixture. As fillers, not only particulate fillers but also fibrous fillers come into consideration. By using the fillers, both the thermal conductivity and the thermal capacity in particular of the plastics materials that are to be used in accordance with the invention and if requisite, the mechanical properties of the heat exchanger elements according to the invention can be optimized.

It is preferred that the plastics material contains a non-metallic filler and/or a metallic filler, wherein the average particle size $D_{50}$ of the respective filler preferably amounts to approx. 100 μm or less.

In regard to the preferred selection of the primary particle size of the plastics material that is to be used in accordance with the invention, the particle size of the fillers in regard to the sought for uniform distribution in the plastics material amounts to approx. 2 μm to approx. 300 μm, preferably, approx. 2 μm to approx. 150 μm.

The ratio of the average particle size $D_{50}$ of the primary particles of the plastics material or materials to the average particle size $D_{50}$ of the fillers preferably lies in the range of approx. 1:2 to approx. 2:1.

Preferably, the non-metallic filler is contained in the plastics material in a proportion of up to approx. 35 weight %. For the metallic filler, proportions of up to approx. 60 weight % can be contained in the plastics material due to the higher density thereof.

The total percentage by volume of the fillers in the plastics material should preferably amount to approx. 50 Vol % or less, more preferably, approx. 40 Vol % or less.

It is preferred that the plastics material that has been processed to form the honeycomb body exhibit a tear resistance of approx. 10 N/mm$^2$ or more as measured in accord with ISO 12086-2 using a strip-like test piece having a cross section of 1×5 mm$^2$. In the case of these strip-like test samples, the tear resistance of the plastics material of the honeycomb body preferably amounts to 15 N/mm$^2$ or more, more preferably, approx. 20 N/mm$^2$ or more, and yet more preferably, approx. 25 N/mm$^2$ or more. Typically, the tear resistance will amount to approx. 35 N/mm$^2$ or less. Within the previously defined ranges of tear resistances, plastics materials without fillers achieve the higher values whereas plastics materials with fillers achieve the lower values.

It is preferred that the tear elongation of the plastics material that has been processed to form the honeycomb body, as measured in accord with ISO 12086-2 on a strip-like test sample having a cross section of 1×5 mm$^2$ amounts to approx. 80% or more, in particular, approx. 100% or more, more preferably, approx. 150% or more, and most preferably, approx. 200% or more.

In accordance with the invention, honeycomb bodies having very easily cleanable surfaces are attainable whereby to this end, the mean roughness value Ra of the surfaces of the honeycomb body as measured in accord with DIN EN ISO 1302 in the longitudinal direction of the honeycomb body channels amounts to approx. 10 μm or less, preferably approx. 5 μm or less.

In regard to cleanability, the surface roughness Rz of the surfaces of the honeycomb body as measured in accord with DIN EN ISO 1302 in the longitudinal direction of the flow channels of the honeycomb body preferably amounts to approx. 50 μm or less, in particular, approx. 40 μm or less, more preferably approx. 30 μm or less, and most preferably, approx. 20 μm or less.

The heat exchanger elements according to the invention or the honeycomb body thereof preferably comprise a plastics material having a thermal conductivity of approx. 0.3 W/(m·K) or more.

The heat exchanger elements according to the invention or the honeycomb body thereof preferably comprises a plastics material having a thermal capacity of approx. 0.9 J/(g·K) or more.

The previously recommended values for the thermal conductivity and the thermal capacity favor effective heat transfer between the heat exchanger elements and the flue gas flowing therethrough as well as the storage capabilities of the heat exchanger element.

In accordance with a preferred geometry, the flow channels of the honeycomb body have a polygonal and in particular a square or a hexagonal cross section.

The channel walls of the flow channels of the honeycomb body preferably have a thickness of approx. 0.8 mm to approx. 2 mm.

The open cross-sectional area of the flow channels of a honeycomb body preferably add up to approx. 75% or more of the surface area of the honeycomb body.

The heat exchanger elements which serve for equipping the seating chambers of a rotor are typically needed with base areas of several different dimensions. This can easily be realized by initially producing standardized honeycomb blocks having a smaller surface area and then jointing them together to form larger honeycomb bodies.

The flow channel geometry may, for example, consist of a hexagonal cross section having an edge length of approx. 7.2 mm or more.

The process of connecting the honeycomb blocks so as to form a whole, easily manageable honeycomb body of a heat exchanger element can be effected mechanically by means of a positive- or force-locking connection for example, or by means of a substance-to-substance bond, for example by adhesion or welding.

Even in this case, the geometry of the heat exchanger element and the honeycomb body thereof can be adapted to the particular requirements by a cutting or sawing process and, in particular, can be formed into a wedge-shape in a plane perpendicular to the longitudinal direction of the flow channels.

The parts of the honeycomb structures separated by cutting the honeycomb blocks or honeycomb body can readily be connected for the purposes of producing further heat exchanger elements with a honeycomb block in the way that has already been described above.

Moreover, the invention relates to heat exchangers for flue gas cleaning systems which contain a plurality of heat exchanger elements of the present invention.

It is preferred that the heat exchangers comprise a ring-shaped seating space or a plurality of ring-segment-like seating spaces that succeed one another in the circumferential direction in which a plurality of the heat exchanger elements according to the invention are accommodated, wherein the heat exchanger elements are connected to one another with positive engagement in the peripheral direction.

In the case of this special configuration of the heat exchangers according to the invention, a plurality of otherwise necessary walls for forming the seating chambers for the individual heat exchanger elements can be dispensed with in the region of the cold end position of the heat exchanger, whereby not only can problems of corrosion be avoided to a large extent, but in addition, a saving of material when manufacturing the heat exchanger can be realized and moreover, the heat exchanger can be manufactured with considerably reduced weight. This applies in principle for the upper and the lower cold end position, whereby however, the construction process is realizable to a greater extent in the upper cold end position in a simple manner.

Due to the positively-locking connection of the heat exchanger elements to one another provided in the circumferential direction, there is generally an adequately secure and precise positioning of the heat exchanger elements in the heat exchanger. This also applies for the positioning in the radial direction, in particular, due to the given ring-shaped structure of the seating space and the substantially trapezoidal surface area of the heat exchanger elements following therefrom.

In the case of the heat exchanger elements that are employed in the framework of these heat exchangers according to the invention, a sealing edge is preferably provided in the neighborhood of the two end faces, whereby a structure of the sealing edge for the positively-locking connection of the one heat exchanger element to a neighboring heat exchanger element is only necessary for one of the sealing edges which is associated with the upper or the lower end face of the heat exchanger element.

In particular, it is then preferred that one of the sealing edges be formed on the honeycomb body whilst the second sealing edge is manufactured as a separate part.

BRIEF DESCRIPTION OF THE DRAWINGS

These and further advantageous embodiments of the invention are described in more detail hereinafter with the aid of the drawings.

These show in detail.

DETAILED DESCRIPTION OF THE DRAWINGS

Figure 1A:
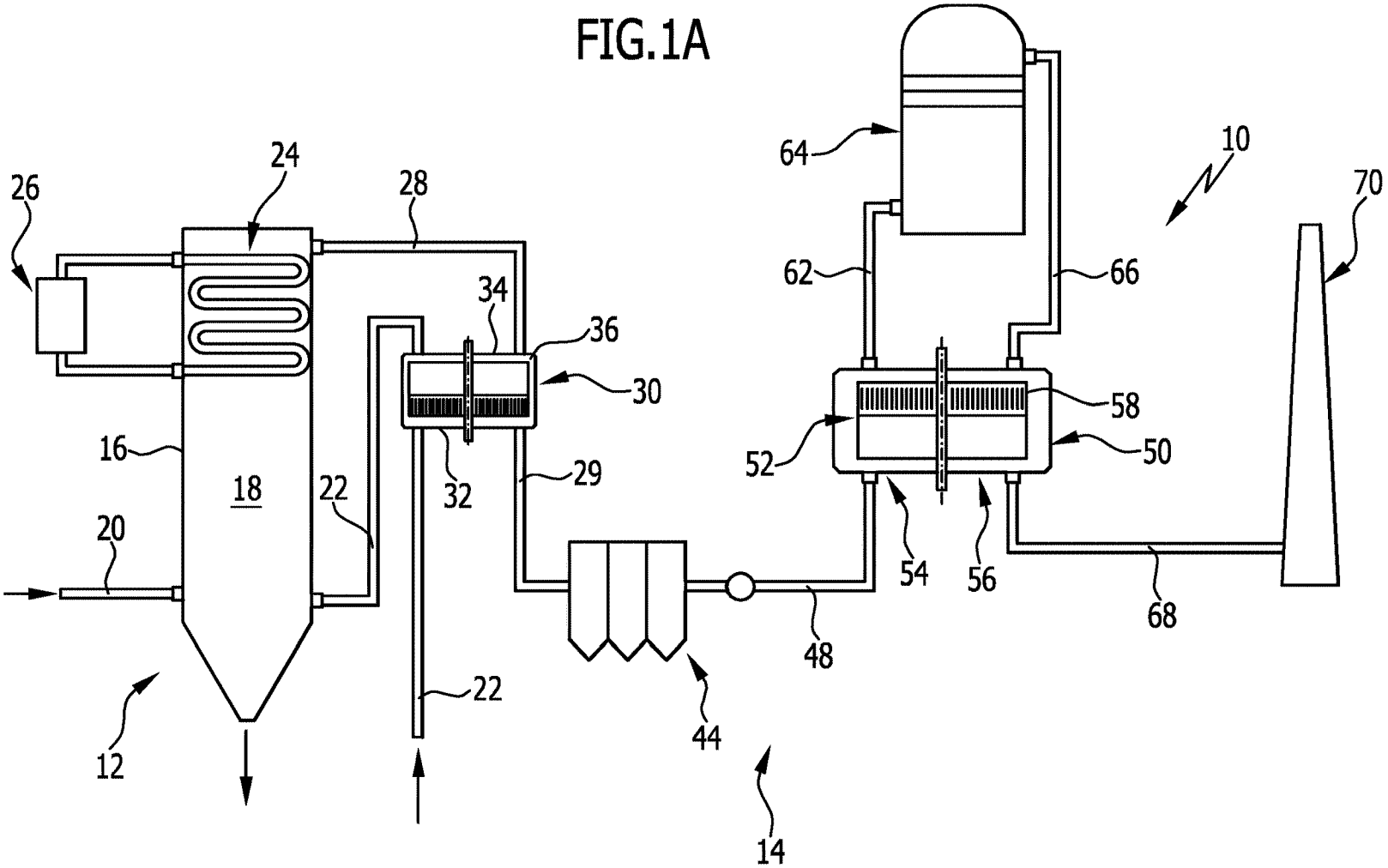
FIG. 1A a schematic illustration of a coal-fired power station incorporating a flue gas cleaning system.

FIG. 1A shows a schematic illustration of a coal-fired power station 10 having a burner 12 and a flue gas cleaning system 14. The burner 12 comprises a boiler 16 having a combustion chamber 18 to which coal in powdered form is fed by way of a fuel supply line 20 and combustion air is supplied by way of a feed line 22. Above the combustion chamber 18 in the boiler 16, there is arranged a steam generator 24 in which water vapor is produced for operating a steam turbine 26. The steam turbine 26 propels a not illustrated power generator. The flue gas resulting from the burning of the coal in the combustion chamber 18 is exhausted from the boiler 16 through a flue gas line 28.

Before being fed into the combustion chamber 18 of the boiler 16, the combustion air is fed via the feed line 22 through a heat exchanger 30 and is heated therein by the flue gas being fed through the flue gas line 28. The heat exchanger comprises an air supply region 32 and a flue gas region 34. As seen in the vertical direction, there are a number of temperature zones in the heat exchanger 30, whereby the zone in which the temperature of the flue gas is lower, is particularly susceptible to corrosion. This zone is also called the cold end position. The cold end position is located at the bottom due to the flow of flue gas through the heat exchanger 30 from top to bottom.

In the heat exchanger 30, there is provided a rotor 36 equipped with a heat storage and transmission medium which absorbs heat from the flue gas being fed through the flue gas region 34 and delivers the heat to the combustion air passing through the oppositely located air supply region 32. The temperature of the flue gas sinks in the course of its passage through the heat exchanger 30 from approx. 250° C. to approx. 160° C. for example, whilst the temperature of the supply air increases from the ambient temperature to approx. 150° C. for example. The diameter of the rotor 36 frequently lies within a range of 5 m to 25 m in dependence upon the requisite capacity of the heat exchanger. Depending upon the size, the weight of a rotor fully equipped with a heat storage and transmission medium can amount to 1000 tons and more, in particular when a conventional medium which is based exclusively on enamelled steel sheets is used.

The cooled flue gas is supplied for dust extraction through the line 29 to an electrostatic particle separator which is referred to hereinafter for short as an ESP unit 44.

After the ESP unit 44, the processed (mostly free of dust) flue gas is supplied over a line 48 to a regenerative heat exchanger 50, which is also referred to as a REGAVO for short, in which the processed flue gas is further cooled from approx. 160° C. to a temperature of approx. 90° C. or lower for example.

The heat exchanger 50 contains a rotor 52 equipped with a heat storage and transmission medium which absorbs the heat delivered by the dust-freed flue gas which for this purpose, is fed through a first region 54 of the heat exchanger 50 or through the rotor 52 from the bottom to the top and is then supplied by way of the line 62 to a flue gas desulphurizing system 64.

The temperature of the dust-freed flue gas sinks during the passage thereof through the first region 54 of the heat exchanger 50 from approx. 150° C. to between approx. 85° C. to approx. 90° C. for example. In the case of this heat exchanger 50, the so-called cold end position 58 is located at the top.

The desulphurized flue gas coming from the flue gas desulphurizing system 64 is still at a temperature within a range of approx. 40° C. to approx. 50° C. for example. Due to the rotary movement of the rotor 52 (or else a so-called hood supply in case of a realization comprising a stator in place of a rotor 52), the heat storage and transmission medium (inter alia, heat accumulator elements according to the invention) that are heated up by the raw gas are brought into contact with the cooler gas flow of the desulphurized flue gas (clean gas). Hereby, the clean gas is fed over the line 66 into the region 56 of the heat exchanger 50 in counter-flow and thereby heated up to approx. 90° C. to approx. 100° C.

A line 68 leads the desulphurized, reheated flue gas from the heat exchanger 50 to the chimney 70. Due to the renewed heating to approx. 90° C. to approx. 100° C., the flue gas has sufficiently great lift to pass out of the chimney into the atmosphere.

For the purposes of heating the supply air and in flue gas desulphurizing systems such as the one shown here and in a plurality of other concepts, the heat exchangers being used are in the form of so-called Ljungström gas pre-heaters that are equipped with a rotor 36 or 52 which take over the transportation of the heat from the flue gas region to the air supply region or from the first to the second region of the respective heat exchanger 30 or 50.

The previously outlined principle applies not only for REGAVO systems but also for so-called APH systems (air pre-heater) and so-called SCR (selective catalytic reduction) and SNCR (selective non catalytic reduction) processes.

Figure 1B:
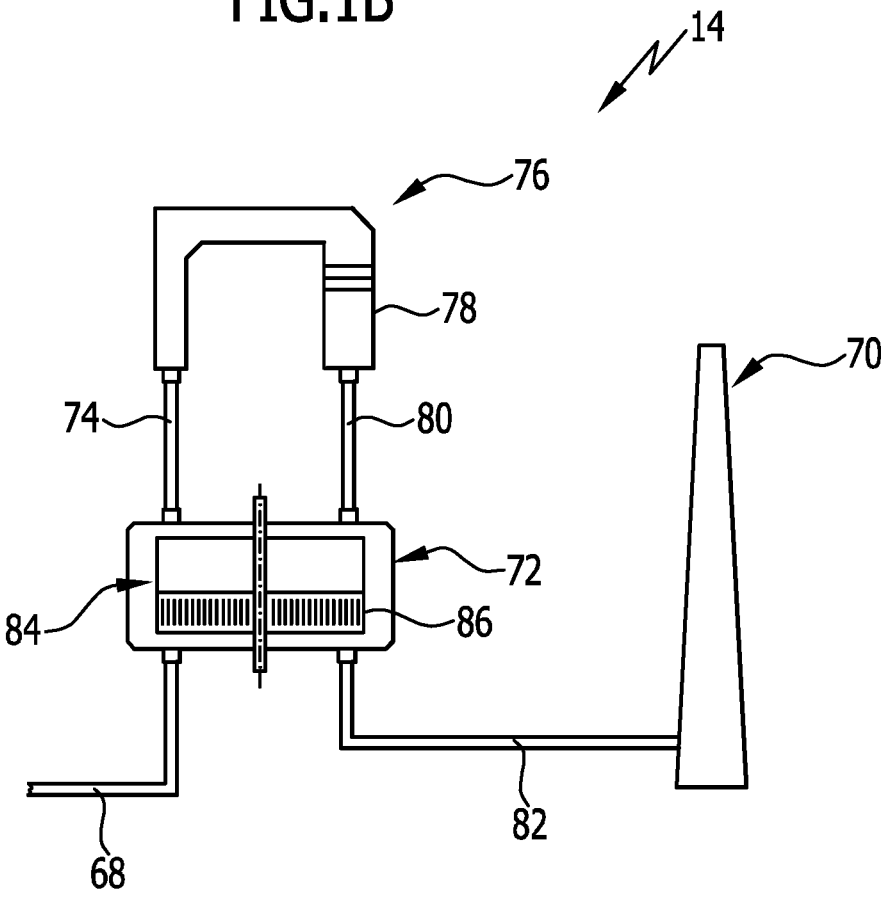
FIG. 1B a variant of the flue gas cleaning system depicted in FIG. 1A.

FIG. 1B shows a variant of the flue gas desulphurizing system 14 in which the line 68 coming from the heat exchanger 50 leads to a heat exchanger 72 to which there is attached via a line 74 a so-called SCR unit 76 which preferably contains a further section 78 having a flue gas nitrogen oxide removal function ($DeNO_x$). The desulphurized flue gas which still contains $NO_x$ fractions is fed via the line 68 through the heat exchanger 72 for preheating purposes. In order for the $NO_x$-containing desulphurized flue gas to reach the temperature of approx. 150° C. to approx. 190° C. that is needed in the following SCR process, the heat exchanger 72 typically has a greater overall height. Hereby, the heat accumulator elements inserted into the heat exchanger 72 must exhibit a high resistance to corrosion since surplus ammonia reacts with existing sulfur trioxide and water and forms ammonium bisulfate. The ammonium bisulfate together with the fly ash that is still contained in the flue gas forms a sticky precipitate which settles on all of the rotor/stator parts and must be regularly washed away.

The heat exchanger 72 contains a rotor 84, in the cold end position 86 of which the heat exchanger elements according to the invention are in turn arranged.

Figure 2A:
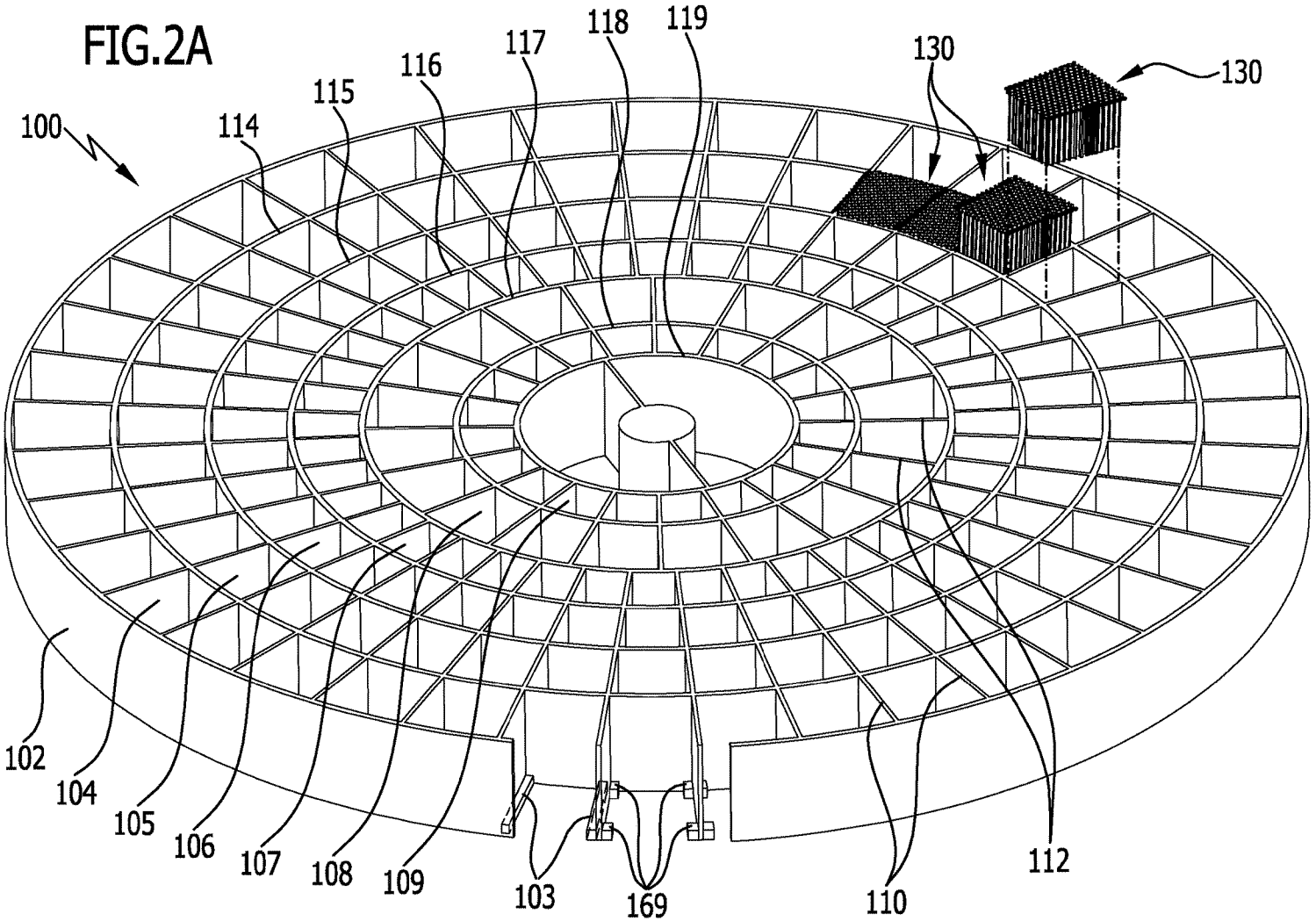
FIGS. 2A to 2C schematic illustrations of three variants of a rotor for accommodating heat exchanger elements according to the invention.

FIG. 2A schematically shows a heat exchanger in the form of the disk-shaped rotor 100 having a diameter which can amount to 20 m and more. The volume of the disk-shaped rotor 100 is bounded by a cylindrical outer wall 102 and is subdivided into a plurality of chambers 104, 105, 106, 107, 108, 109 having a substantially trapezoidal outline. The sub-dividing process is effected on the one hand by means of a number of radially running partition walls 110, 112 and on the other hand by means of cylinder walls 114, 115, 116, 117, 118 and the inner wall 119 which are formed concentrically with the outer wall.

The chambers 104, 105, 106, 107, 108, 109 can be equipped with appropriately sized exchangeable heat exchanger elements according to the invention 130 which are arranged in an upper cold end position in this exemplary embodiment. Such heat exchanger elements 130 comprise a honeycomb body 132 through which there passes a plurality of flow channels 152 which run parallel to the axial direction of the rotor 100 as will be described in more detail with the aid of FIG. 3.

In the frontal region of the rotor 100 shown, the chambers 104 are depicted in the form of a partially sectional illustration, whereby at the lower end of the chamber walls 110 in one variant, there are provided supporting strips 103 on which, in accordance with another exemplary embodiment, heat exchanger elements according to the invention can be placed in a lower cold end position. In a further alternative, the heat exchanger elements can also be held in the lower cold end position by means of block shaped holding elements 169.

In a further variant, the heat exchanger elements can be accommodated in special mountings together with another type of heat exchanger element and can be fixed in the chamber by means of the supporting strips 103 or the block shaped holding elements 169 as will be described in more detail hereinafter with the aid of FIGS. 6A, 6B and 7.

Figure 2B:
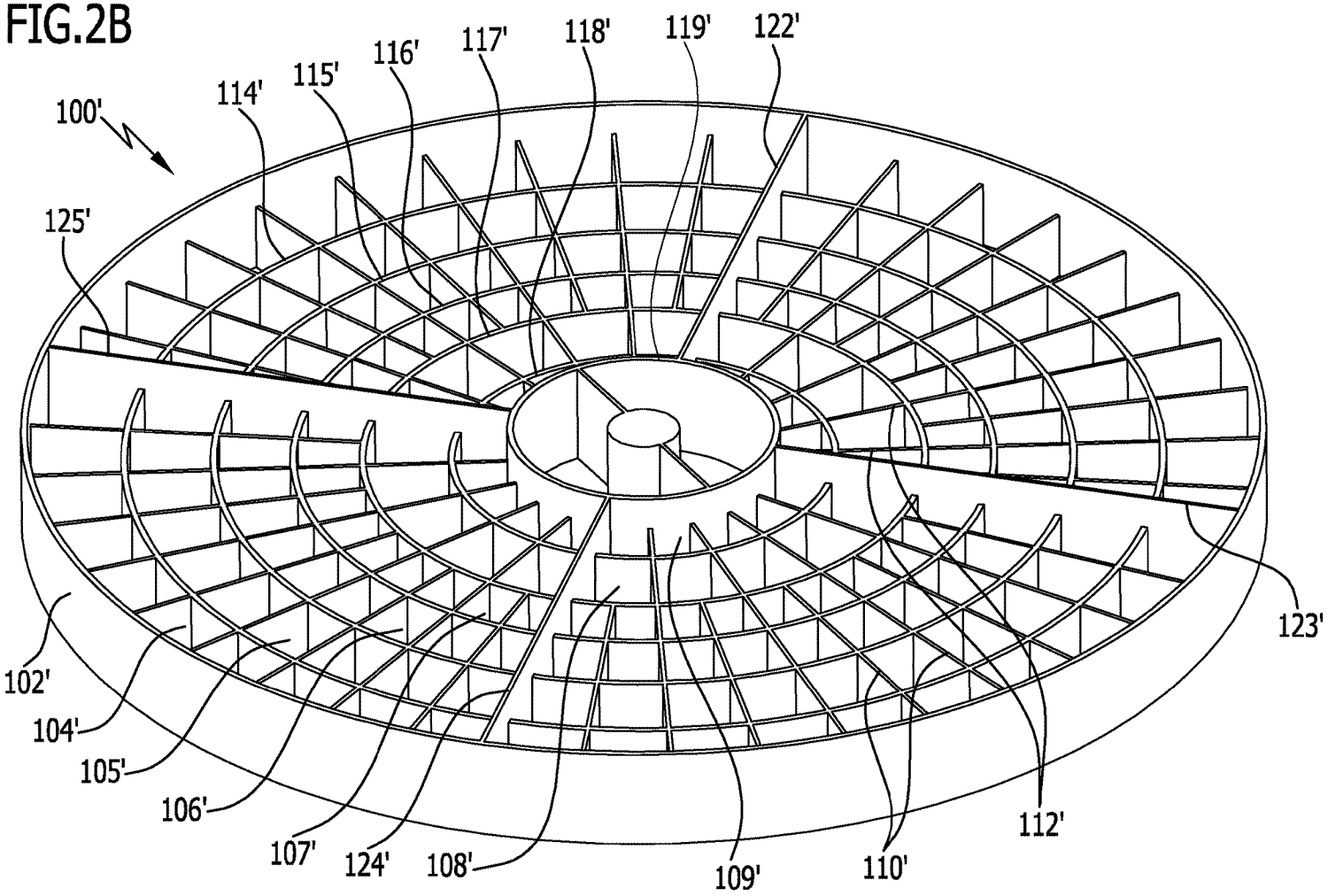

FIG. 2B shows a rotor 100' which is subdivided, in the lower region (hot end position) thereof that extends over approx. two thirds of the height of the rotor 100' for example, into seating chambers 104', 105', 106', 107', 108', 109' by means of radial and partition walls 110', 112' that run in the circumferential direction as well as by cylinder walls 114', 115', 116', 117', 118' and the inner wall 119' that are concentric with the outer wall 102.

The upper third of the volume of the rotor 100' (upper cold end position) is bounded on the one hand by the outer wall 102' as well as the cylindrical inner wall 119'. This annular space is only subdivided into four ring segments by four radially extending walls 122', 123', 124', 125' that are of the same height as the inner wall 119' and the outer wall 102'. A plurality of heat exchanger elements according to the invention are respectively accommodated in these ring segments as will be described hereinafter, these preferably being connected to one another by means of interlocking elements at the sealing edges thereof which adjoin one another in the circumferential direction.

This variant of the rotor 100' signifies a considerably smaller amount of material being utilized in the manufacture of the rotor or the seating chambers thereof so that the rotor itself is then of lower weight.

Moreover, a plurality of partition wall walls within the cold end position region of the rotor 100' are redundant so that the corrosion phenomena arising there can, to a great extent, also be avoided.

Figure 2C:
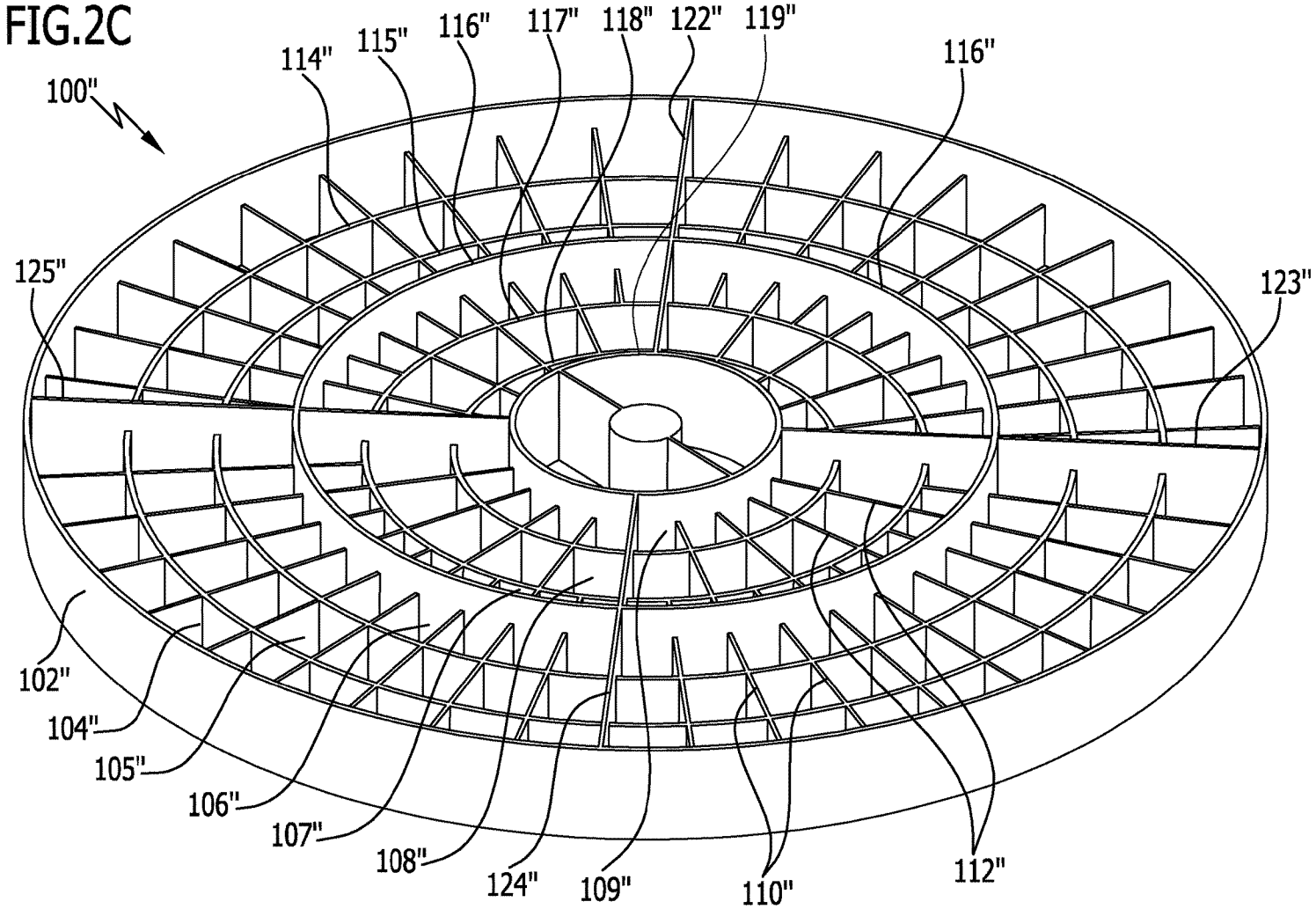

A further variant of a rotor 100" is shown in FIG. 2C which is constructed in a similar manner to the rotor 100' in FIG. 2B and in which the rotor volume that is to be filled with heat exchanger elements is bounded on the one hand by the outer wall 102" and the cylindrical inner wall 119". The subdivision of the rotor volume into seating chambers in the lower two thirds of the volume of the rotor 100" is maintained as is evident from FIGS. 2A and 2B, whereby the partition walls 114", 115", 116", 117", 118", 110", 112" running in the circumferential direction or extending radially are utilized once again. The seating chambers 104", 105", 106", 107", 108" and 109" that are formed thereby accommodate heat exchanger elements for the hot end position region as has already been described in connection with FIG. 2A and FIG. 2B.

Above these seating chambers 104", 105", 106", 107", 108" and 109", there are annular regions which are, to a large extent, free of partition walls and are merely divided into four ring segments by radial partition walls 122", 123", 124" and 125" in analogous manner to that described in connection with FIG. 2B.

In addition, in the case of the rotor 100" of FIG. 2C, the cylindrical partition wall 116" is of the same height as the outer wall 102" and the inner wall 119" so that it again divides the ring segments located between the radial partition walls 122", 123", 124" and 125" into two regions in the radial direction.

The construction of this circular partition wall 116" also serves to improve the mechanical stability thereof particularly in the case of large rotor dimensions in similar manner to that applying in respect of the radial partition walls 122", 123", 124" and 125".

In the case of very small rotors, the additional function of the circular partition wall 116" as well as that of the radial partition walls 122", 123", 124" and 125" can in principle be dispensed with so that just a single annular space is provided for accommodating the heat exchanger elements according to the invention in the cold end position.

If heat exchanger elements according to the invention are employed which, on the one hand, are connectable in positively-locking manner in the circumferential direction and, in the case of a preferably trapezoidal outline on the other, this additionally results in accurate positioning of the individual heat exchanger elements after the rotor/stator has been equipped thereby enabling one to dispense with the partition walls for the formation of individual seating chambers for the individual heat exchanger elements.

The heat exchanger elements that are to be inserted into the rotors 100' and 100" preferably comprise a sealing edge in the vicinity of the two end faces of which the upper sealing edge is preferably formed in one-piece with the honeycomb body of the heat exchanger elements. As is to be explained in detail in connection with the description of FIG. 7B, the lower sealing edge can serve for covering the upper end faces of the partition walls in the region of the transition from the hot to the cold end position.

Figure 3:
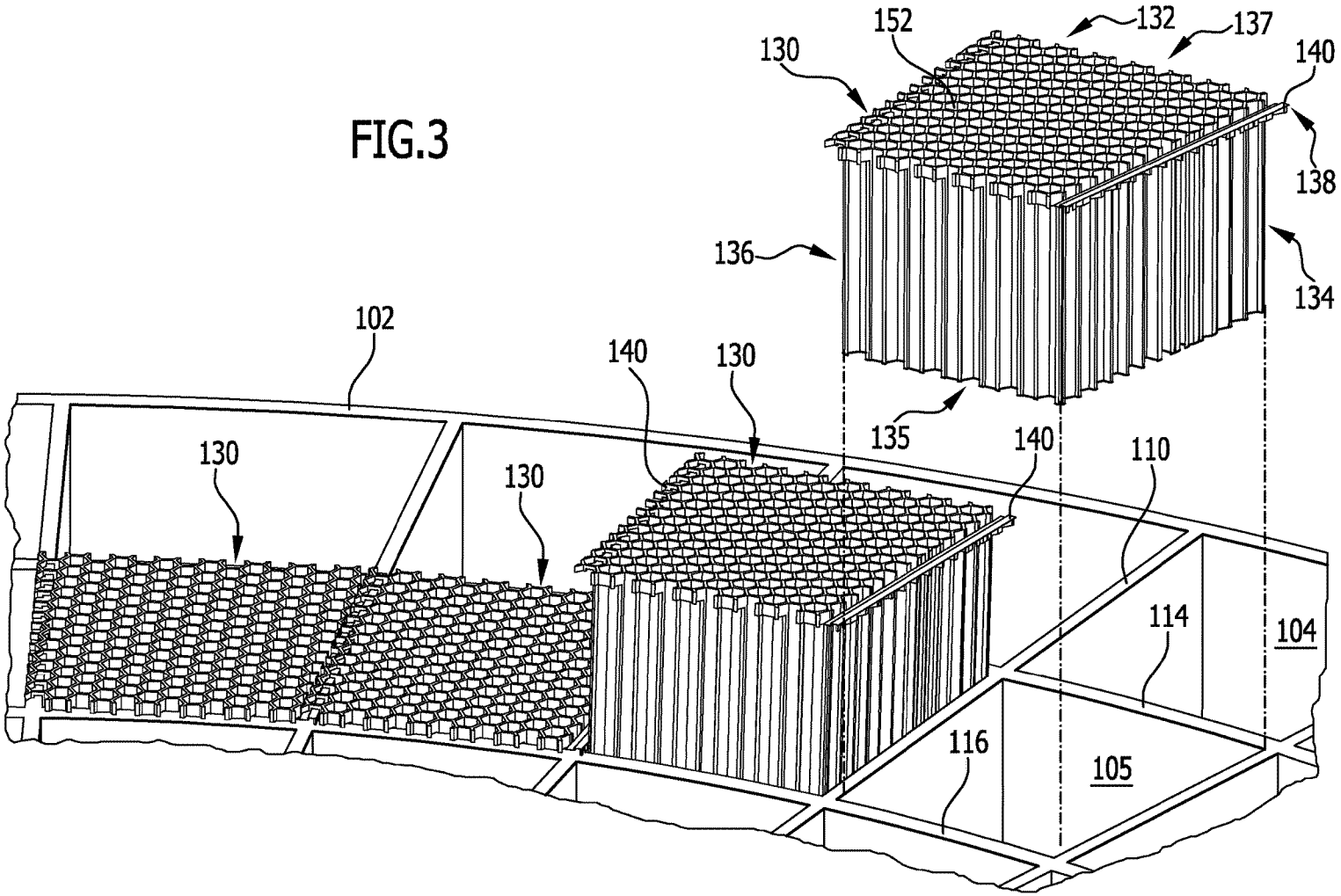
FIG. 3 an enlarged extract from FIG. 2A.

FIG. 3 shows a detail of the rotor 100 in which a portion of the chambers 105 is equipped with heat exchanger elements 130. The heat exchanger elements 130 comprise a honeycomb body 132 which is provided on the four outer sides 134, 135, 136, 137 thereof at the height of the upper end face 138 thereof with a surrounding sealing edge 140 which is formed in one-piece with the honeycomb body 132 and the basic structure of which is likewise in the form of a honeycomb. Consequently, the heat exchanger element according to the invention 130 in the form of the honeycomb body 132 and the basic structure of the sealing edge 140 can be manufactured in one-piece from an appropriately larger dimensioned honeycomb block. In the case of the disposition of the heat exchanger elements 130 in an upper cold end position as shown in FIG. 3, the sealing edge 140 can adopt a further function namely, that of a carrier for the heat exchanger element 130. The sealing edge 140 formed on the honeycomb body is sufficiently stable for mounting and positioning the heat exchanger elements 130 in the rotor 100 in the upper cold end position.

In order to obtain an adequate sealing effect, the honeycomb-like basic structure of the sealing edge 140 must also be covered in gas-impermeable manner. This can be effected very easily using a planar material which is placed on the basic structure of the sealing edge 140. One of the preferred planar materials is a foil of plastics material such as PTFE for example. The planar material can, if so required, be connected to the basic structure by adhesion or welding.

Alternatively, the honeycomb-like basic structure of the sealing edge 140 could also be compressed or filled with a filler material (not shown) such as to be gas-impermeable.

As is apparent from FIG. 3, the sealing edge 140 is formed in such a way that, after a heat exchanger element 130 has been inserted into a rotor chamber from above, it covers the upper face of the rotor walls surrounding the rotor chamber (here for example, the rotor walls 110, 114 and 116 of the rotor chamber 105) and likewise shields these upper faces from the corrosive materials of the flue gas. FIG. 3 shows the process of inserting a heat exchanger element according to the invention 130 in several phases.

Preferably, the sealing edge 140 is provided with a respective recess 142, 144 on two mutually opposite outer faces of the honeycomb body 132 on the upper face and on the lower face so that the sealing edges 140 of two heat exchanger elements 130 that are adjacent to one another in the circumferential direction of the rotor can overlap each other in a planar configuration.

Surprisingly, the sealing edge 140 deploys its protective effect for the material of the rotor walls despite being arranged on the downstream side and not on the upstream side of the heat exchanger element 130 since the flow pattern is restricted to the flow channels of the honeycomb bodies 132 due to the sealing edge 140.

In order to obtain particularly precise positioning of neighboring heat exchanger elements 130 according to the invention in the circumferential direction, it is further preferred that the sealing edge 140 be formed with complementary positively-locking elements in the region of the recesses 142, 144 as is apparent in detail particularly in FIGS. 4A to 4D. These can be realized in the form of groove-shaped recesses 146 or strip-like projections 148 for example as is shown in detail in FIGS. 4A to 4D.

Figure 4A:
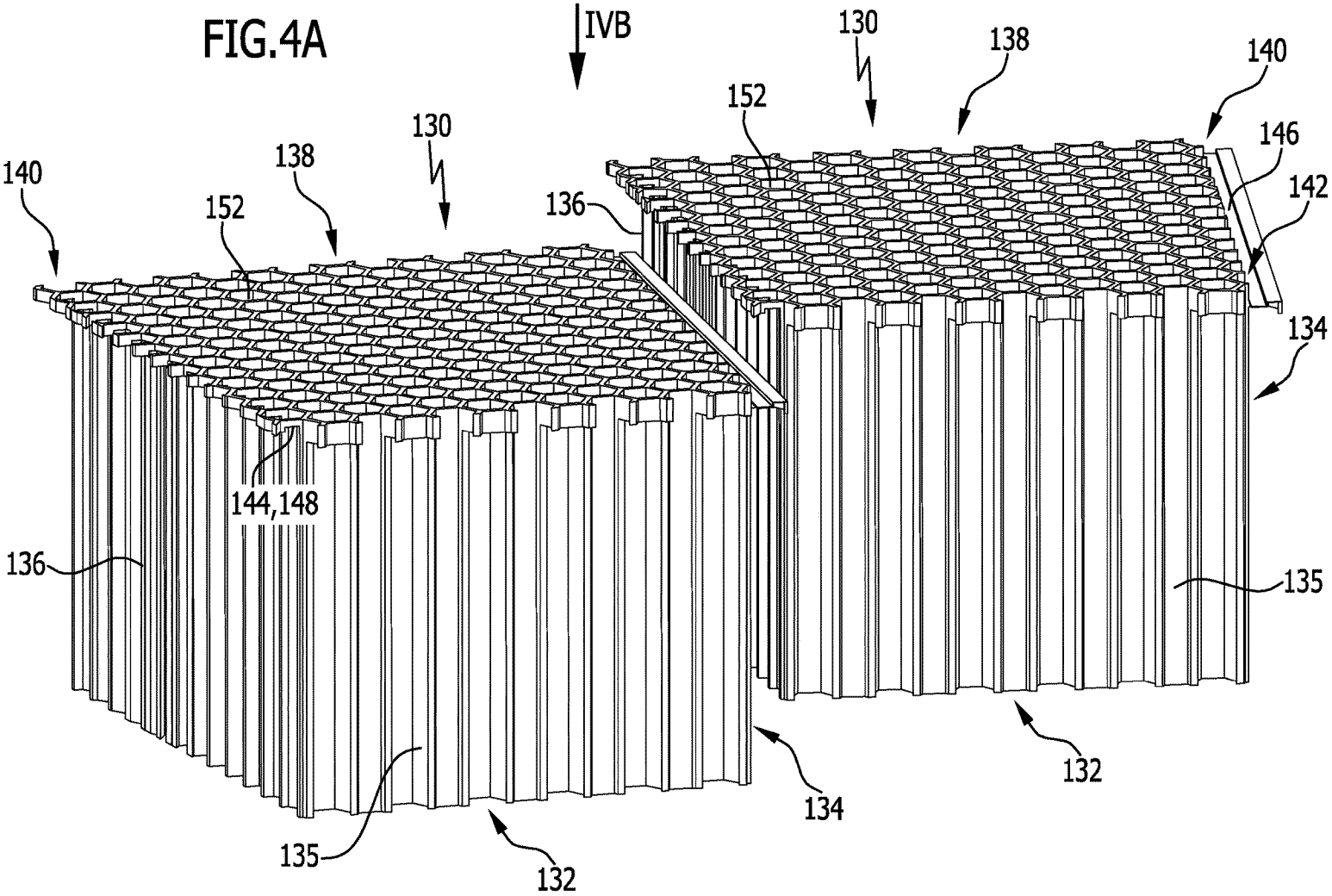
FIGS. 4A to 4D a schematic illustration of two heat exchanger elements according to the invention which are to be connected to one another in interlocking manner.

Thus, FIG. 4A shows two heat exchanger elements 130 that are mutually aligned laterally shortly before being connected at the outer faces 134 and 136 thereof by the sealing edges 140. The sealing edge 140 comprises a recess 142 in the upper face thereof in the section thereof running along the outer face 134, whilst a recess 144 is formed in the lower face thereof in the section thereof running along the outer face 136. The recesses 142, 144 preferably extend along the respective entire section of the sealing edge 140.

Figure 4B:
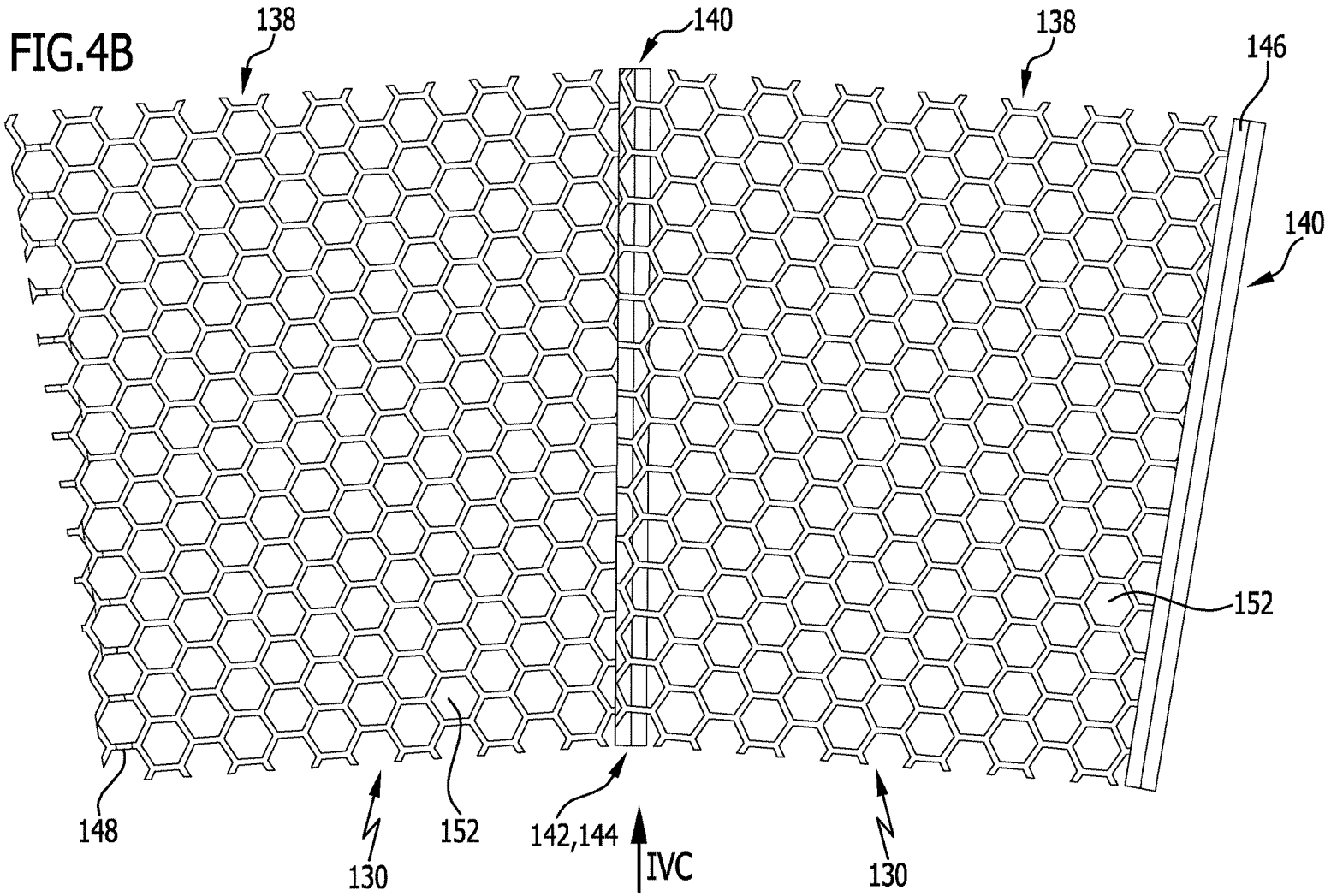
Figure 4C:
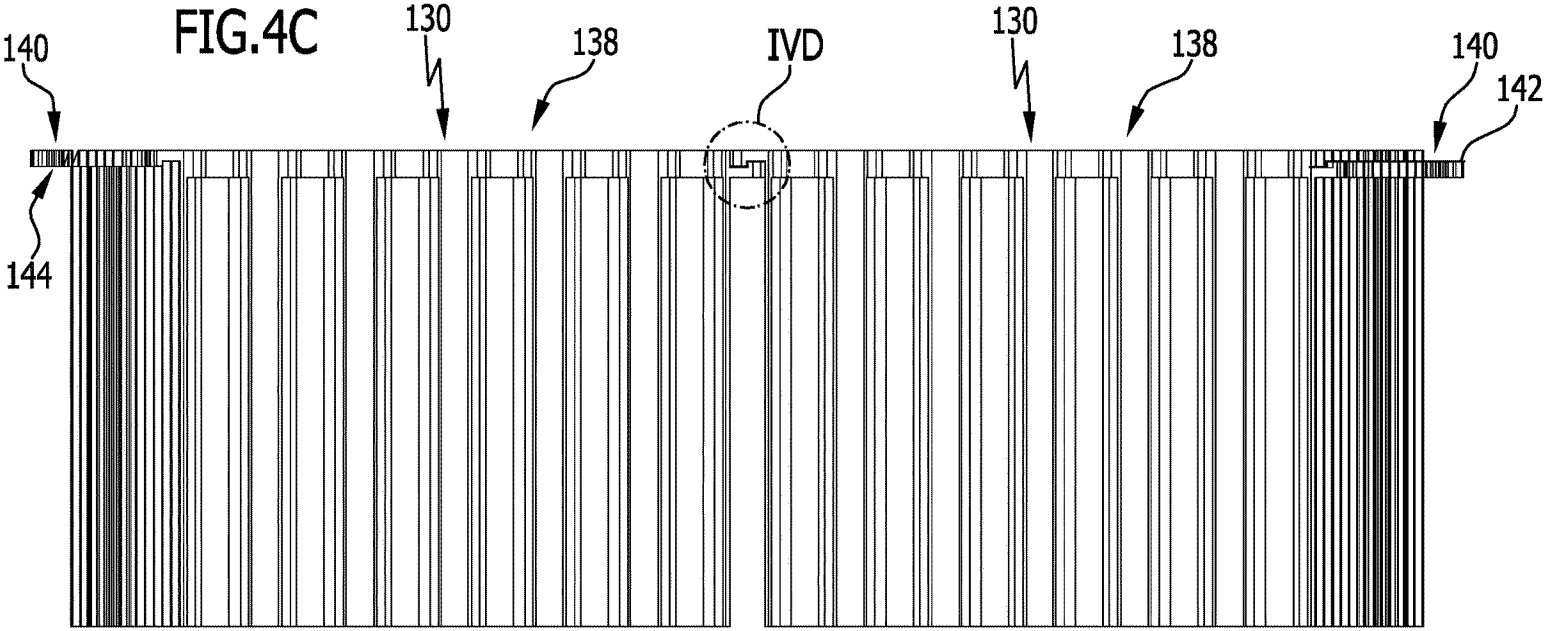

This also becomes clear from the plan view of FIG. 4B and the side view of FIG. 4C in which two heat exchanger elements 130 are illustrated when connected to one another.

Figure 4D:
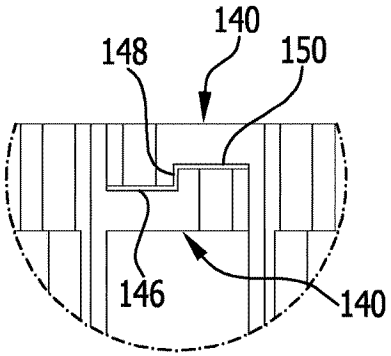

Finally, FIG. 4D shows a detail of the overlapping sealing edges 140 in the form of an enlarged illustration wherein the co-operation of the interlocking elements 146 and 148 can be clearly seen. The foil 150 in the form of a gas-impermeable planar element which is placed between the recesses 142, 144 is also clearly apparent in this Figure. For the purposes of providing gas-impermeable coverage, it is generally sufficient to provide just one foil layer which can either be inserted between the sealing edges 140 of neighboring heat exchanger elements 130 during the assembly process or which is fixed to the sealing edge 140 of only one of the heat exchanger elements 130 (e.g., by adhesion or welding) before the assembly process. In FIG. 4B, this is the case for the sealing edge 140 shown at the left of the picture.

Even if it is only laid in between the overlapping sealing edges 140 of the neighboring heat exchanger elements 130, the foil 150 is fixed sufficiently firmly merely by virtue of the dead weight of the heat exchanger elements 130 which are supported on the rotor walls 110 by the sealing edges 140 thereof.

The honeycomb bodies 132 comprise a plurality of parallel flow channels 152 which extend from one end face 138 to the oppositely located end face. The cross-sectional area of the flow channels 152 is hexagonal in the exemplary embodiments shown. In the case of a flow channel wall thickness of 1.2 mm, this results in a free cross section for the flow of gases through the honeycomb body 132 of approx. 83% with respect to the surface area of the honeycomb body 132 in the case where the oppositely located flow channel walls are spaced from each other by a spacing of 14.3 mm (the extent of the respective channel walls is approx. 7.2 mm). The specific surface area amounts to about 150 $m^2/m^3$.

For technical production reasons, the heat exchanger elements or the honeycomb bodies thereof are frequently not manufactured as a block but, depending upon the size required, several, for example, two or four, parallelepipedal honeycomb blocks are firstly manufactured and connected to one another and in particular welded to one another, and the heat exchanger elements 130 are then produced by cutting these into the requisite trapezoidal or wedge shape.

Figure 5A:
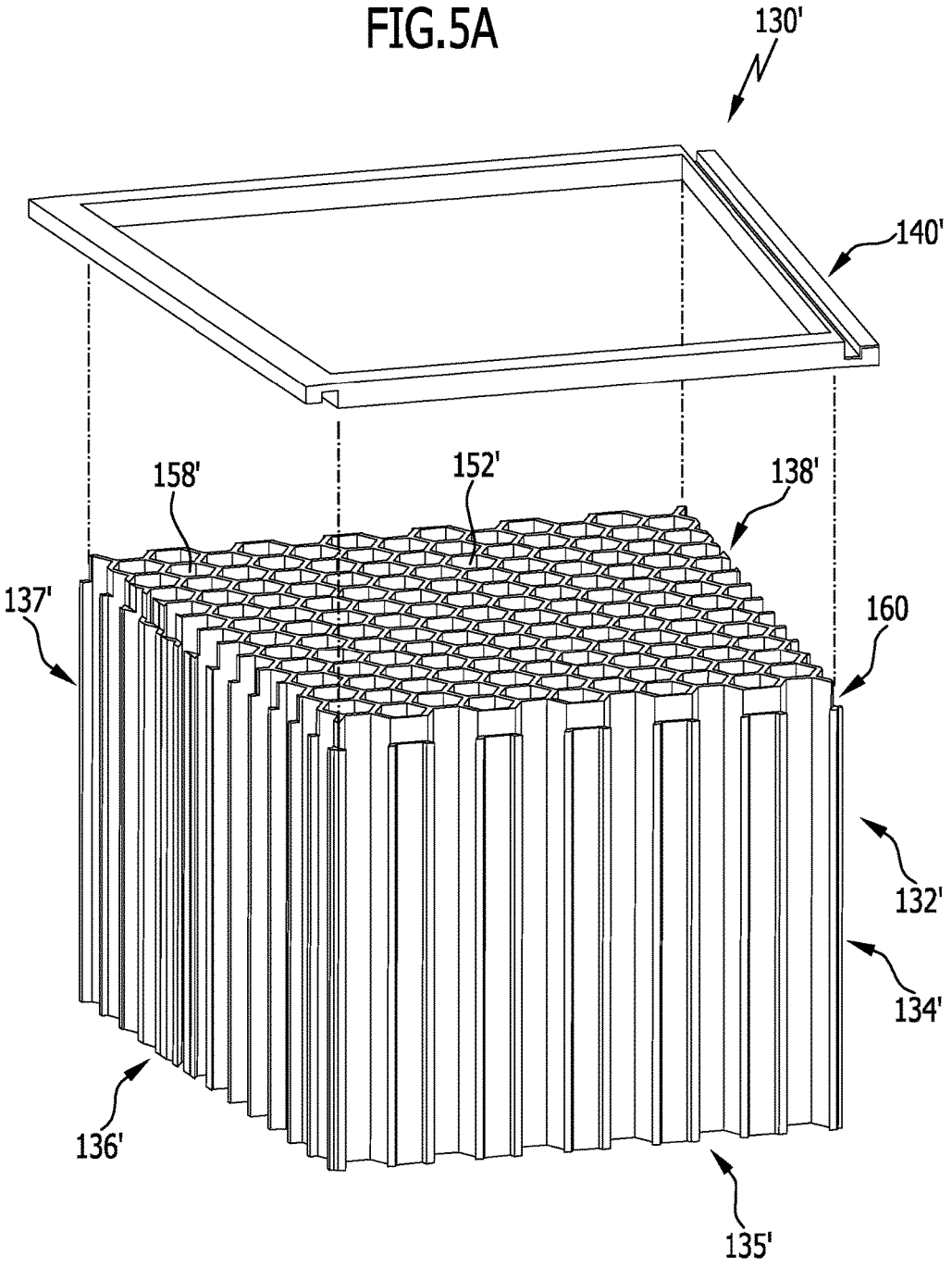
FIG. 5A to 5C schematic illustrations of further variants of a heat exchanger element according to the invention.
Figure 5B:
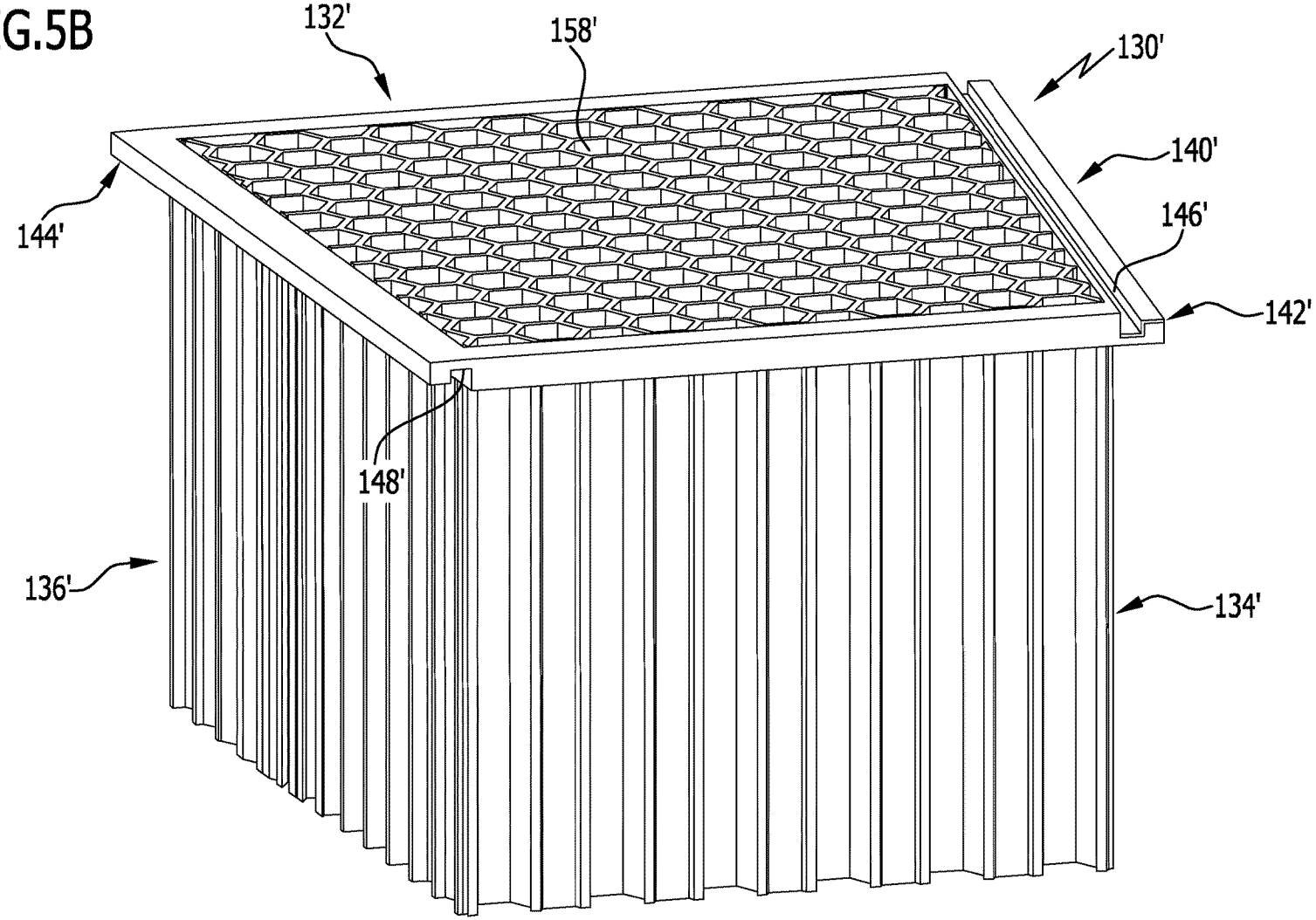
Figure 5C:
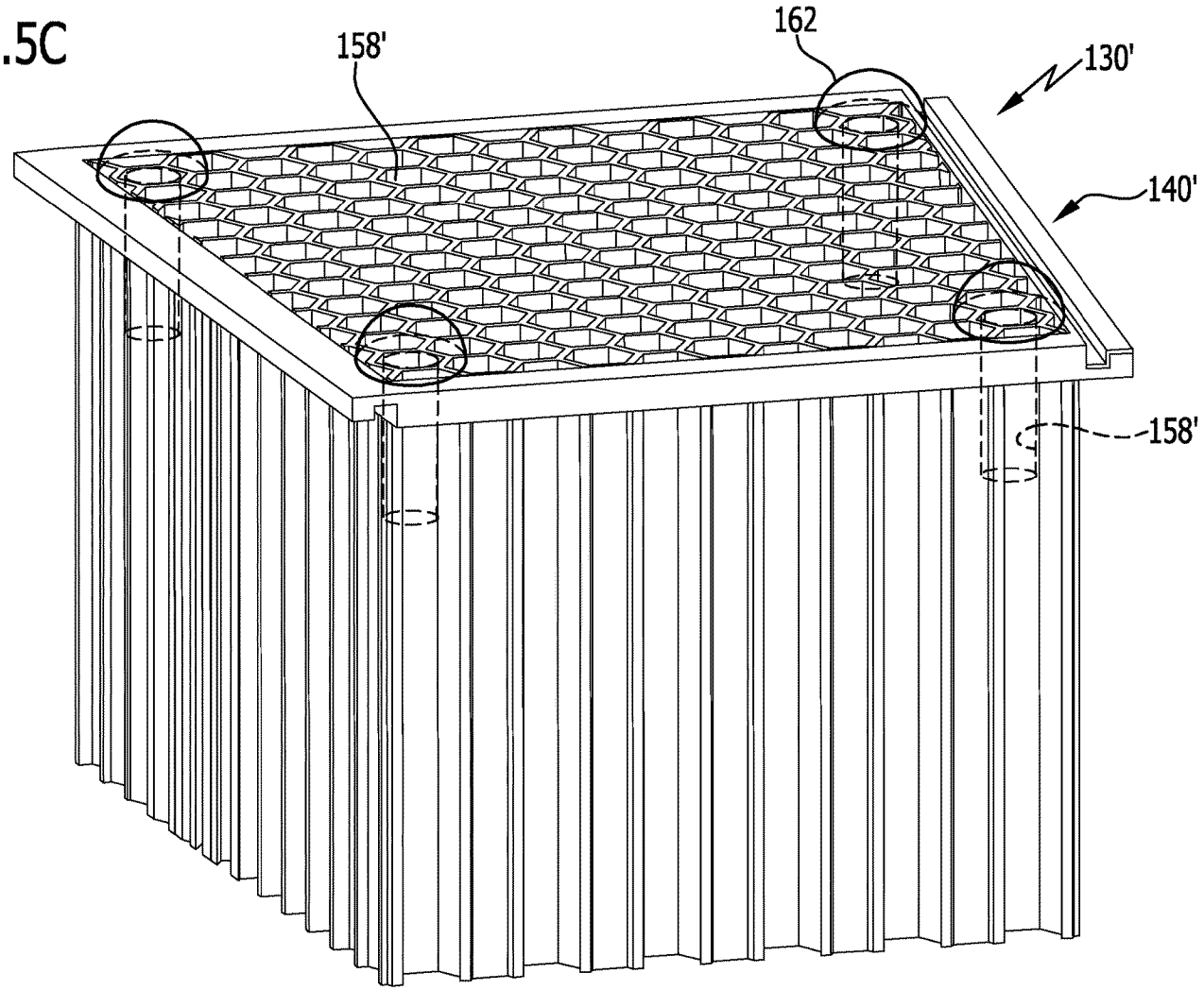

FIGS. 5A to 5C show an alternative embodiment of a heat exchanger element 130' according to the invention.

In this embodiment, the honeycomb body 132' and the sealing edge 140' are each manufactured as separate components which can be joined together prior to or else when mounting the heat exchanger elements 130' in the seating chamber of the rotor. The separately manufactured sealing edge 140' is typically finished with a compact, gas-impermeable structure as shown in FIGS. 5A to 5C.

The exemplary embodiments of FIGS. 5A to 5C show a heat exchanger element 130' which is again conceived for an upper cold end position. The honeycomb body 132' comprises a recess 160 outgoing from the upper end face 138' and surrounding the outer faces 134', 135', 136' and 137' for the purposes of accommodating the sealing edge 140' in a positively-locking manner.

FIG. 5A shows the two separately manufactured components, i.e. the honeycomb body 132' and the sealing edge 140' before assembly, whilst the two components are shown in the assembled state in FIG. 5B.

In order to fulfil a function as a carrier, the sealing edge 140' should preferably be connected to the honeycomb body 132' by a substance-to-substance bond in addition to the positively-locking connection, for example, by welding or adhesion. As an alternative to the substance-to-substance bond, fixing could also be provided by fastening means as shown by an example in FIG. 5C. There, four locking bolts 162 which can be adhered or bolted into a flow channel 158' for example serve for ensuring secure retention of the sealing edges 140' so that the latter can also take on the function of carriers for the heat exchanger element 130'.

The configuration of the sealing edge on two mutually opposite sections or outer sides of the honeycomb body 132' is effected in similar manner to the sealing edge 140 of the heat exchanger elements 130. The sealing edge 140' therefore comprises a recess 142' on one side 134' of the honeycomb body 132' at the upper end thereof, whilst at the oppositely located side 136' of the honeycomb body 132' the sealing edge comprises a recess 144' at the lower end thereof. The sealing edge sections of neighboring heat exchanger elements 130' can be accommodated in the rotor in overlapping manner by means of the recesses 142' and 144'. At the same time thereby, the possibility again arises of using the sealing edge 140' as a carrier for the heat exchanger elements 130' whereby a planar upper face of the equipped rotor is ensured.

Here too, positively-locking elements 146' 148' which are formed in a similar manner to those of the sealing edge 140 of the heat exchanger element 130 preferably serve for precise positioning of the heat exchanger elements 130' according to the invention in the circumferential direction of the rotor so that reference can be made to the description thereof.

Figure 6A:
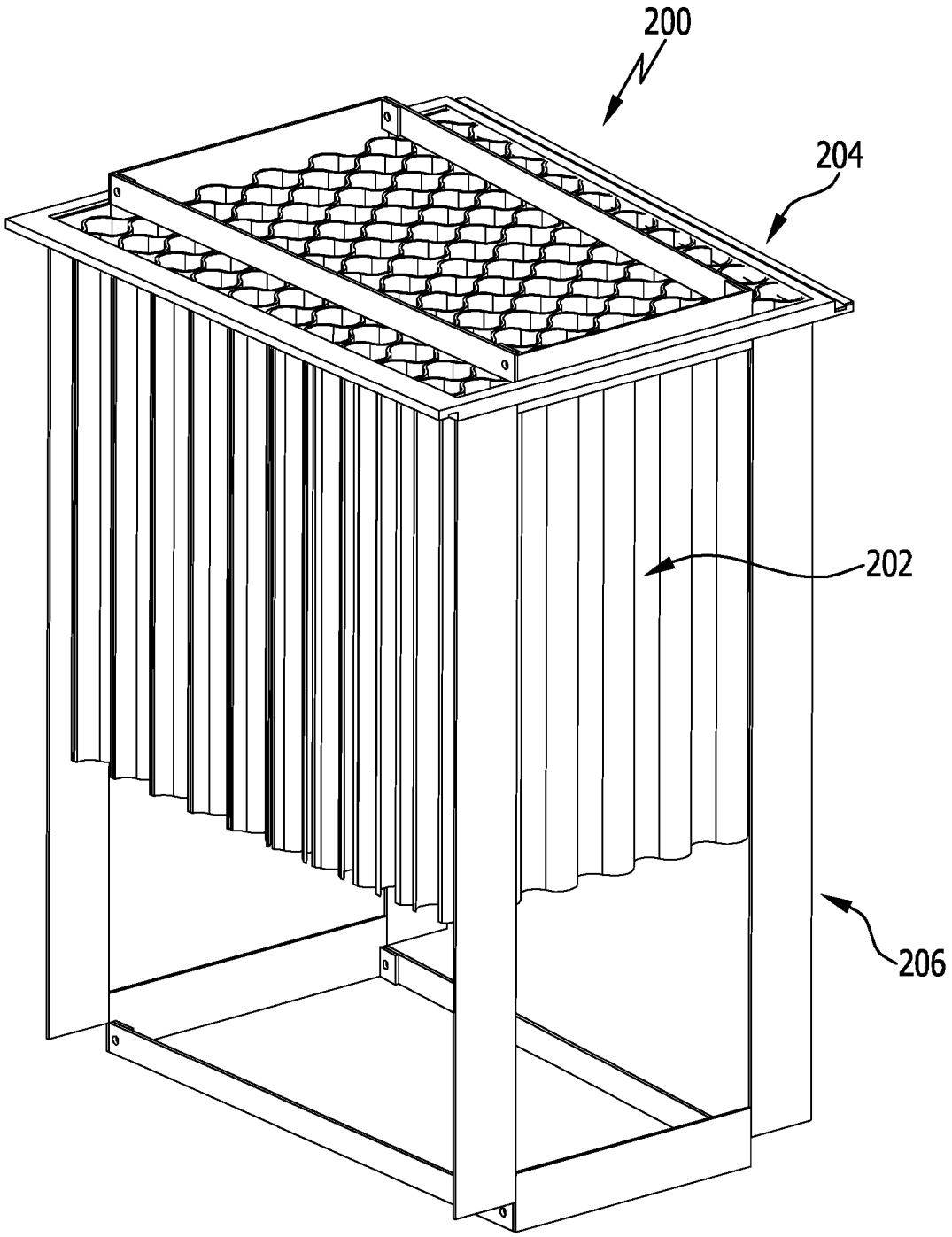
FIGS. 6A and 6B further variants of heat exchanger elements according to the invention which are made use of positioned in a mounting.

FIG. 6A shows a further alternative embodiment of a heat exchanger element 200 according to the invention which comprises a mounting 206 in addition to a honeycomb body 202 and a sealing edge 204. The mounting preferably comprises a cage-like frame structure as is shown in FIG. 6 A for example.

Hereby, the mounting 206 is preferably dimensioned in such a way that it extends over substantially the entire height of the rotor 100 (c.f. FIG. 2A) and, as seen in the direction of flow through the rotor, it can, apart from the honeycomb body 202, accommodate a further heat exchanger component (not shown) for the hot end position that is aligned with the heat exchanger element 200.

In the event that it is used in an upper cold end position, the sealing edge 204 of the heat exchanger element 200 can again be in the form of a carrier for the heat exchanger element 200 as a whole which is supported on the end faces of the rotor walls 110. Here preferably, the honeycomb body 202 and the sealing edge 204 are manufactured as separate components, whereby the assembly process and in particular too the integration of a further heat exchanger component arranged underneath the honeycomb body 202 can be accomplished in a simple manner.

For the purposes of fixing the sealing edge 204 to the honeycomb body 204, the techniques described in connection with FIGS. 5A to 5C are again available. Alternatively, the sealing edge can also be fixed to the mounting 206. This too can be effected by a substance-to-substance band or in positive- or force-locking manner.

Alternatively, the heat exchanger element 200 could also be held above the mounting 206 in a rotor chamber which is supported thereby on supporting strips 103 or on block shaped supporting elements 169 (see FIG. 2A).

Figure 6B:
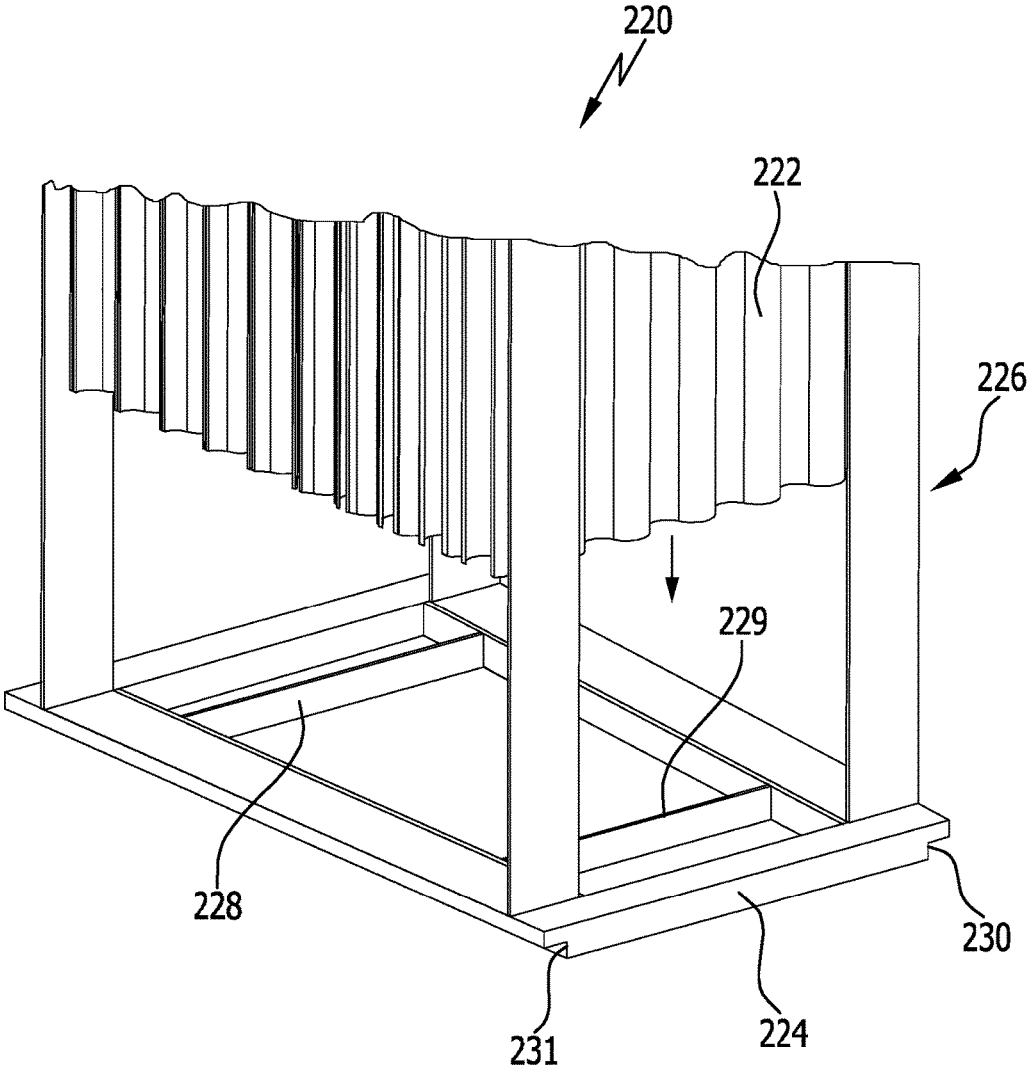

An exemplary embodiment of a heat exchanger element 220 according to the invention comprising a honeycomb body 222, a sealing edge 224 and a mounting 226 is shown in FIG. 6B.

In the case of the heat exchanger element 220, the honeycomb body 222 is utilized in the rotor 100 in a lower cold end position. For example, the sealing edge 224 is then supported on supporting strips 103 or block shaped supporting elements 169 (see FIG. 2A) in the respective rotor chamber. The honeycomb body 222 illustrated in FIG. 6B is still in a raised position. The honeycomb body 222 is seated on transverse bars 228, 229 of the mounting 226 in the final position thereof.

Here, the sealing edge 224 is arranged below on the mounting 226 and is fixed thereto if so required so that the heat exchanger element 220 can be handled as a whole. Alternatively, provision could also be made for the sealing edge 224 to be in the form of a separately handleable element which is first inserted alone into a rotor chamber when assembling the heat exchanger element 220. It is only after this process that the further components of the heat exchanger element 220, i.e. the honeycomb body 222 that is installed in the mounting 226 possibly together with a further heat exchanger component (not shown), are inserted into the rotor chamber.

Consequently, in both cases, the sealing edge 224 preferably comprises notches 230, 231 in the lower side thereof in which the supporting strips 103 or the block shaped supporting elements 169 engage during the assembly process.

The sealing edge 224 itself, which is manufactured here as a separate component, is preferably finished as a compact, substantially gas proof structure.

Figure 7A:
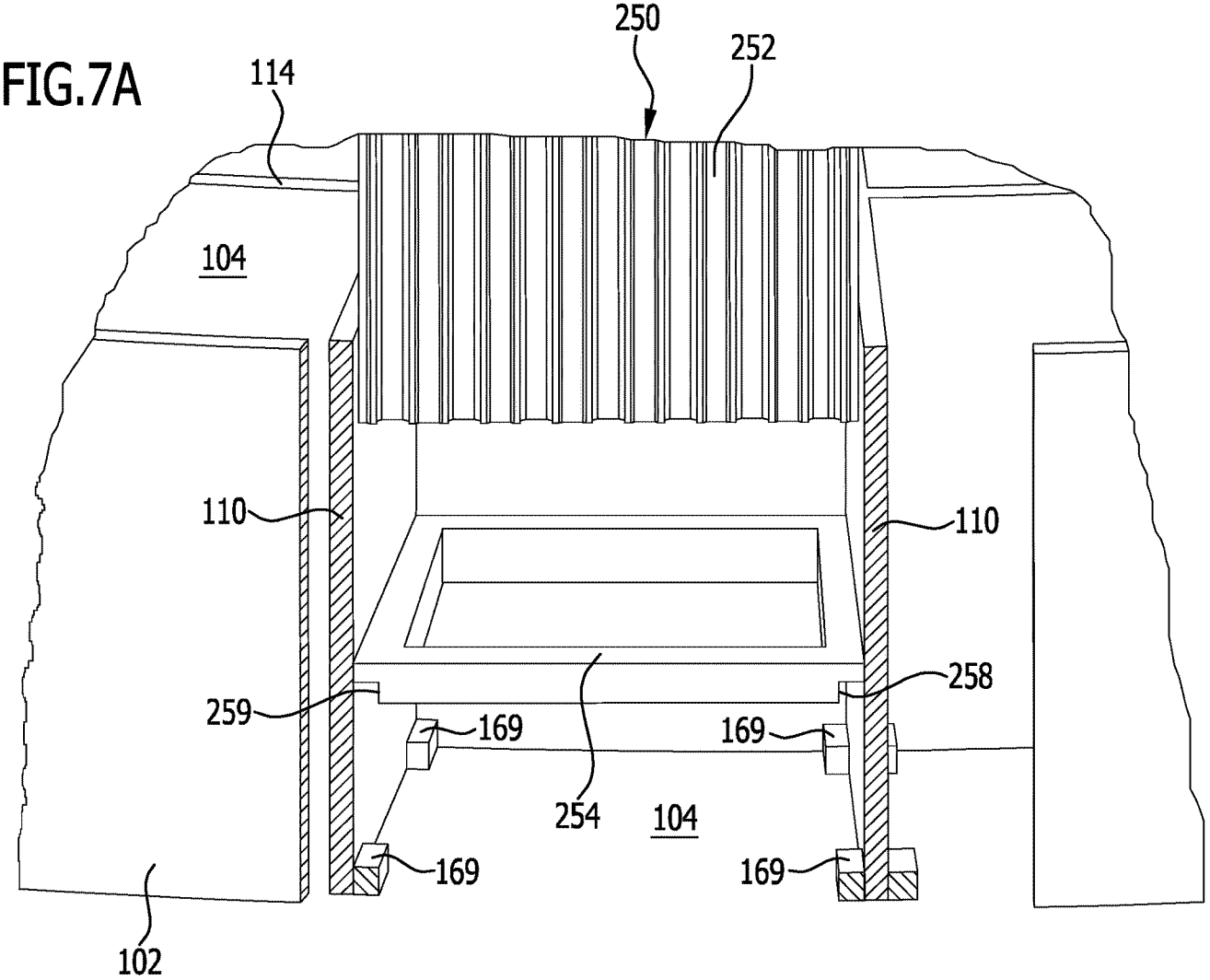
FIG. 7A a further variant of a heat exchanger element according to the invention when being inserted into a rotor chamber.

FIG. 7A shows a further embodiment of a heat exchanger element 250 according to the invention comprising a honeycomb body 252 and a sealing edge 254 for mounting in a lower cold end position of the rotor 100 (c.f. FIG. 2A).

The rotor chamber 104 comprises at the lower edge thereof on mutually opposite sides the block shaped supporting elements 169 that have already been described in connection with FIG. 2A, but self-evidently, differently shaped supporting elements such as the supporting strips 103 that are likewise illustrated in FIG. 2A for example could be employed in their place.

FIG. 7A shows the sealing edge 254 which is still in a raised position above the lower edge of the rotor chamber 104 and the supporting elements 169. In accordance with a variant, the sealing edge is retained as a separately handled part and is inserted first into the rotor chamber 104. It is only after this has been done that the honeycomb body 252 is placed on the sealing edge 254. A fixed connection between the sealing edge 254 and the honeycomb body 252 can be dispensed with since the positioning of the honeycomb body 252 on the sealing edge 254 is already sufficiently gas-impermeable due to the dead weight of the honeycomb body 252.

The sealing edge 254 comprises notches 258, 259 in which the supporting elements 169 can engage on mutually opposite sections in the lower side.

Alternatively, the sealing edge 254 could be connected to the honeycomb body 252 prior to or else after being mounted in the rotor chamber 104, whereby once again a substance-to-substance bond, a positively-locking connection and/or a force-locking connection can be selected, in particular too, the variants which were described in connection with FIGS. 5A to 5C.

Surprisingly, the sealing edge 254 again deploys the protective effect thereof for the material of the rotor walls here too even though it is not arranged on the upstream side of the heat exchanger element 250, but rather, on the downstream side of the rotor 100.

Figure 7B:
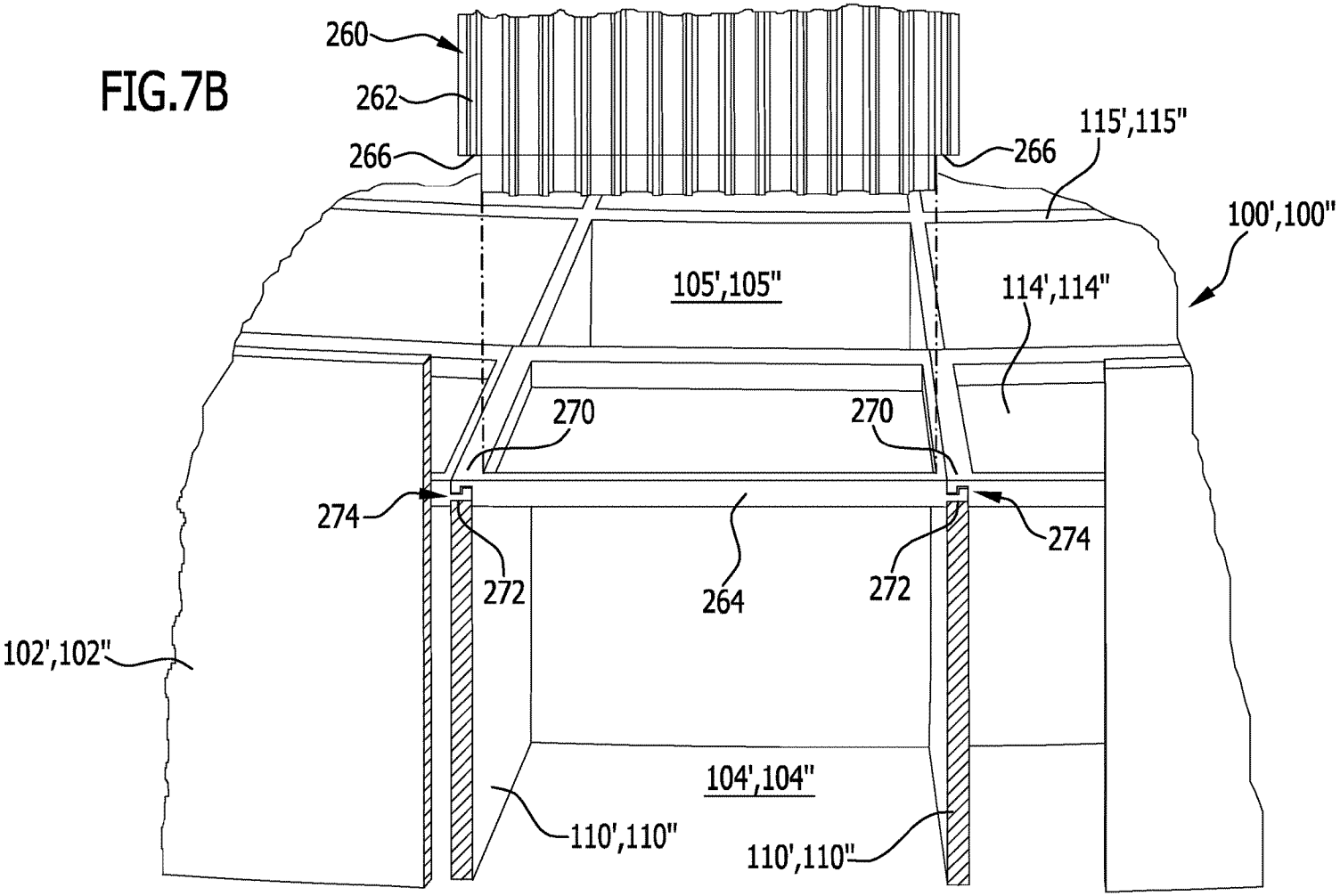
FIG. 7B a variant of the heat exchanger element according to the invention that is adapted to a modified rotor.

Finally, FIG. 7B shows an installation situation for heat exchanger elements 250 according to the invention in an upper cold end position in a rotor 100' or 100" wherein ring or ring-segment shaped seating regions for the heat exchanger elements 250 according to the invention are formed by the outer wall 102', 102" and the (here not shown) radial partition walls as well as the inner wall.

Individual seating chambers 104', 104", 105', 105" etc. which are formed by radially extending partition walls 110', 110" and partition walls 114', 114" or 115', 115" etc. running in the circumferential direction are also provided In the lower region (approx. two thirds of the height of the rotor outer wall 102', 102").

In the cold end position, heat exchanger elements according to the invention are again utilized, these being employed here in the form of the heat exchanger elements 260 comprising a honeycomb body 262 and a sealing edge 264, whereby the sealing edge 264 is preferably constructed as a separately handled component.

The honeycomb body 262 has a surrounding recess 266 on the lower end face thereof which can be inserted into the sealing edge 264.

The sealing edge 264 is again formed on two mutually opposite sides in the circumferential direction of the rotor 100', 100' with a configuration comprising recesses in the upper face or the lower face which are also additionally provided with positively-locking elements, these being indicated as a whole here by the reference symbol 274 for the sake of simplicity.

Here, the same principles can be employed for the sealing edges 140' as were described in the context of FIGS. 5A and 5B so that reference can be made to the more detailed explanations contained in the description for the Figures of FIGS. 5A and 5B.

Preferably, the heat exchanger elements 260 comprise additional sealing edges (not shown) at the upper end faces thereof, these presenting a substantially closed structure between neighboring heat exchanger elements 260 when mutually adjacent at the upper face of the heat exchanger 100', 100".

These sealing edges arranged at the upper end are preferably formed in one-piece with the honeycomb body 262 thereby simplifying the handling of the heat exchanger elements 260 during the installation thereof in the rotor 100', 100".

As is apparent from FIG. 7B, rings of heat exchanger elements 260 that are arranged concentrically in the circumferential direction can be accommodated in the rotor 100', 100", these maintaining accurate positioning on the one hand due to the special structure of the sealing edges 264, but on the other hand, also due to the trapezoidal basic design of the heat exchanger elements 260.

Self-evidently, wall elements such as are used in other exemplary embodiments in order to form individual seating chambers for the heat exchanger elements 260 are not necessary as is apparent from this exemplary embodiment so that the formation of chambers within the rotors 100', 100" can be restricted to the region of the so-called hot end position thereby achieving substantial savings in material and as a consequence thereof a reduction in weight as well. Moreover, as already described hereinabove, the risks of corrosion of the rotor 100', 100" or the components thereof are significantly reduced.

The heat exchanger elements according to the invention must be regularly cleaned due to the entry of corrosive gases and ash particles via the flue gas—even in the processed, dust-freed state thereof—so that simple and safe handling of these elements on the one hand but also simple cleaning of the honeycomb structure on the other hand is of great importance. The tearing resistance and tear elongation (measured in accord with ISO 12086-2) of the honeycomb body walls as well as the surface properties thereof and in particular the chemical resistance and the roughness, measured as surface roughness and mean roughness value (measured in accord with DIN EN ISO 1302) thereby play a significant role.

The heat resistance of the PTFE material is also of importance in regard to the temperatures of the flue gases occurring in the heat exchangers of approx. 250° C. for example.

For the effectiveness of the rotor containing the heat exchanger elements during the process of heat transfer from the one gas stream to the respective counter-flowing gas stream, the parameters of thermal capacity and thermal conductivity of the heat storage and transmission media being used have a significant bearing.

The present invention also takes into consideration these criteria by the selection of the plastics materials and, if necessary, the fillers for the production of the heat exchanger elements or the honeycomb blocks used for the production thereof.

The invention claimed is:

1. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the channel walls of the flow channels of the honeycomb body have a thickness of approx. 0.8 mm to approx. 2 mm.

2. The heat exchanger element in accordance with claim 1, wherein the sealing edge is formed in one-piece with the honeycomb body.

3. The heat exchanger element in accordance with claim 1, wherein the sealing edge is in the form of a separate component.

4. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the sealing edge comprises an open honeycomb structure which is at least partially covered by a planar material in substantially gas-impermeable manner.

5. The heat exchanger element in accordance with claim 1, wherein the sealing edge comprises a compact substantially gas-impermeable structure.

6. The heat exchanger element in accordance with claim 3, wherein the sealing edge is connected directly to the honeycomb body by means of positive- and/or force-locking or by a substance-to-substance bond or is held on the honeycomb body by means of securing elements.

7. The heat exchanger element in accordance with claim 1, wherein the sealing edge is made of a plastics material which, in particular, is selected from the plastics material of the honeycomb body and PFA.

8. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the sealing edge is formed in the region of a first outer face of the honeycomb body with a recess on the upper face thereof which runs substantially parallel to the outer face and is formed in the region of a second outer face located opposite the first outer face with a complementary recess on the lower face thereof which extends parallel to the second outer face of the honeycomb body.

9. The heat exchanger element in accordance with claim 8, wherein the sealing edge is equipped with complementary interlocking elements in the region of the recesses.

10. The heat exchanger element in accordance with claim 1, wherein the sealing edge is formed as a carrier for the honeycomb body.

11. The heat exchanger element in accordance with claim 10, wherein the sealing edge formed as a carrier of the honeycomb body is provided at two oppositely located outer faces of the honeycomb block with bearing surfaces for the purposes of providing support at or on a wall of a seating chamber of the heat exchanger.

12. The heat exchanger element in accordance with claim 11, wherein the bearing surfaces of the sealing edge are positioned on such outer faces of the honeycomb body as extend substantially parallel to the radial direction of the heat exchanger.

13. The heat exchanger element in accordance with claim 1, wherein the heat exchanger element comprises a mounting in which the honeycomb body is accommodated.

14. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the plastics material further comprises a high performance polymer differing from the PTFE in a proportion of approx. 20 weight % or less, and wherein the virgin PTFE comprises a co-monomer component of approx. 1 weight % or less.

15. The heat exchanger element in accordance with claim 14, wherein the virgin PTFE and optionally the high performance polymer differing from the PTFE have an average primary particle size $D_{50}$ of approx. 10 μm to approx. 100 μm.

16. The heat exchanger element in accordance with claim 1, wherein a mean roughness value Ra of the surfaces of the honeycomb body as measured in the longitudinal direction of the honeycomb block channels amounts to approx. 5 μm or less, and/or in that the surface roughness Rz of the surfaces of the honeycomb block as measured in the longitudinal direction of the flow channels of the honeycomb block amounts to approx. 30 μm or less.

17. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the plastics material comprises a non-metallic filler and/or a metallic filler, wherein the particle size $D_{50}$ of the respective filler preferably amounts to approx. 100 μm or less, and preferably in that the non-metallic filler is contained in the plastics material in a proportion of approx. 35 weight % or less, and/or the metallic filler is contained in the plastics material in a proportion of approx. 60 weight % or less.

18. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the plastics material comprises a plastic which contains virgin polytetrafluoroethylene (PTFE) in a proportion of approx. 80 weight % or more; and wherein the plastics material of the honeycomb block exhibits a thermal conductivity of approx. 0.3 W (m·K) or more and/or in that the plastics material of the honeycomb block exhibits a thermal capacity of approx. 0.9 J/(g·K) or more.

19. A heat exchanger for flue gas cleaning systems comprising a plurality of heat exchanger elements in accordance with claim 1.

20. The heat exchanger in accordance with claim 19, wherein the heat exchanger comprises a ring-shaped seating space or a plurality of ring segment shaped seating spaces in which a plurality of heat exchanger elements are accommodated, wherein the heat exchanger elements are connected to one another in the peripheral direction with positive engagement.

21. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the sealing edge comprises an open honeycomb structure which is at least partially covered by a planar material in substantially gas-impermeable manner.

22. A heat exchanger element for equipping heat exchangers of flue gas cleaning systems of power stations, wherein the heat exchanger element comprises a block shaped honeycomb body having four outer faces and two substantially parallel end faces and a sealing edge, wherein the honeycomb body is formed from a plastics material having a plurality of mutually parallel flow channels which are separated from each other by channel walls, wherein the flow channels extend from the one end face to the other end face, and wherein the sealing edge is arranged in the region of one of the end faces and is substantially parallel to this end face and extends away from the honeycomb body at the periphery of the honeycomb body;

wherein the sealing edge is formed in the region of a first outer face of the honeycomb body with a recess on the upper face thereof which runs substantially parallel to the outer face and is formed in the region of a second outer face located opposite the first outer face with a complementary recess on the lower face thereof which extends parallel to the second outer face of the honeycomb body.

23. The heat exchanger element in accordance with claim 22, wherein the sealing edge is equipped with complementary interlocking elements in the region of the recesses.

* * * * *